US011703787B2

(12) United States Patent
Ogiso et al.

(10) Patent No.: US 11,703,787 B2
(45) Date of Patent: Jul. 18, 2023

(54) FIXING DEVICE AND IMAGE FORMING APPARATUS INCORPORATING SAME

(71) Applicants: Toshio Ogiso, Tokyo (JP); Tamotsu Ikeda, Tokyo (JP)

(72) Inventors: Toshio Ogiso, Tokyo (JP); Tamotsu Ikeda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/724,028

(22) Filed: Apr. 19, 2022

(65) Prior Publication Data

US 2022/0373950 A1 Nov. 24, 2022

(30) Foreign Application Priority Data

May 24, 2021 (JP) ..... 2021-086705

(51) Int. Cl.
*G03G 15/20* (2006.01)

(52) U.S. Cl.
CPC ..... *G03G 15/2064* (2013.01); *G03G 15/2028* (2013.01); *G03G 2215/2048* (2013.01)

(58) Field of Classification Search
CPC ..... G03G 15/2028
See application file for complete search history.

(56) References Cited

U.S. PATENT DOCUMENTS 4,843,214 A * 6/1989 Higashi ..... G03G 15/2028 399/328
5,289,244 A * 2/1994 Takano ..... G03G 15/2028 399/339
5,589,925 A * 12/1996 Cahill ..... G03G 15/2028 399/323
6,400,923 B1 6/2002 Fukuda et al.
7,187,895 B2 * 3/2007 Nakano ..... G03G 15/6573 399/322
9,323,195 B2 * 4/2016 Matsumoto ..... G03G 15/2028
9,753,416 B2 * 9/2017 Okamoto ..... G03G 15/2028
2004/0057759 A1 3/2004 Ogiso et al.
2005/0129431 A1 6/2005 Oohara et al.
(Continued)

FOREIGN PATENT DOCUMENTS

JP 7-140819 6/1995
JP 2001083827 A * 3/2001
(Continued)

*Primary Examiner* — Sevan A Aydin
(74) *Attorney, Agent, or Firm* — Harness, Dickey & Pierce, P.L.C.

(57) ABSTRACT

A fixing device includes a heater, a heating rotator, a nip formation rotator, and an entry guide. The entry guide guides each of a first recording medium having a predetermined length or more and a second recording medium having a length less than the predetermined length to the fixing nip. The entry guide includes a first and second entry guide portion. The first entry guide portion guides the first recording medium toward a harder one of the heating rotator and the nip formation rotator and has an opening. The second entry guide portion guides the second recording passing through the opening to the fixing nip along a reference line connecting an entry and exit of the fixing nip or guides the second recording medium from an area including a softer one of the heating rotator and the nip formation rotator with respect to the reference line to the fixing nip.

19 Claims, 12 Drawing Sheets

(56) References Cited

U.S. PATENT DOCUMENTS

| | | | | |
|---|---|---|---|---|
| 2005/0147436 | A1 | 7/2005 | Koyama et al. | |
| 2005/0254866 | A1 | 11/2005 | Obata et al. | |
| 2006/0034646 | A1 | 2/2006 | Hiraoka et al. | |
| 2007/0071467 | A1 | 3/2007 | Mitsuya et al. | |
| 2007/0071514 | A1 | 3/2007 | Yagi et al. | |
| 2007/0196145 | A1 | 8/2007 | Matsumoto et al. | |
| 2008/0013993 | A1 | 1/2008 | Obata et al. | |
| 2011/0188874 | A1 | 8/2011 | Takahashi et al. | |
| 2012/0002997 | A1* | 1/2012 | Hiraoka | G03G 15/2064 399/92 |
| 2012/0063829 | A1 | 3/2012 | Matsuyama et al. | |
| 2012/0195652 | A1* | 8/2012 | Takahashi | G03G 15/2028 399/323 |
| 2012/0328318 | A1 | 12/2012 | Ogiso et al. | |
| 2013/0004192 | A1 | 1/2013 | Kawakami et al. | |
| 2013/0004222 | A1 | 1/2013 | Sakaya et al. | |
| 2016/0306314 | A1* | 10/2016 | Suto | H04N 1/00 |
| 2016/0313684 | A1 | 10/2016 | Ikeda | |
| 2017/0176900 | A1* | 6/2017 | Shimodaira | G03G 15/2028 |
| 2018/0067431 | A1 | 3/2018 | Nanno et al. | |
| 2021/0364962 | A1 | 11/2021 | Ikeda | |

FOREIGN PATENT DOCUMENTS

| | | |
|---|---|---|
| JP | 2013-015551 | 1/2013 |
| JP | 2013-083712 | 5/2013 |
| JP | 2018-017947 | 2/2018 |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2021-086705, filed on May 24, 2021, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Related Art

One type of fixing device includes a heater, a heating rotator heated by the heater, a nip formation rotator that contacts the heating rotator to form a fixing nip, and an entry guide that guides a recording medium entering the fixing nip.

SUMMARY

This specification describes an improved fixing device that includes a heater, a heating rotator, a nip formation rotator, and an entry guide. The heater heat the heating rotator. The nip formation rotator is in contact with the heating rotator to form a fixing nip. The entry guide guides each of a first recording medium having a predetermined length or more in an axial direction of the heating rotator and a second recording medium having a length less than the predetermined length in the axial direction to the fixing nip. The entry guide includes a first entry guide portion and a second entry guide portion. The first entry guide portion guides the first recording medium toward a harder one of the heating rotator and the nip formation rotator. The first entry guide portion has an opening disposed corresponding to a center of the heating rotator. The second recording medium passes through the opening. The second entry guide portion guides the second recording medium passing through the opening of the first entry guide portion to the fixing nip along a reference line connecting an entry of the fixing nip and an exit of the fixing nip in a cross-section of the fixing device orthogonal to the axial direction, or guides the second recording medium passing through the opening of the first entry guide portion from an area including a softer one of the heating rotator and the nip formation rotator with respect to the reference line to the fixing nip in the cross-section of the fixing device orthogonal to the axial direction.

This specification further describes an improved fixing device that includes a heater, a heating rotator, a nip formation rotator, and an ejection guide. The heater heats the heating rotator. The nip formation rotator is in contact with the heating rotator to form a fixing nip. The ejection guide guides each of a first recording medium having a predetermined length or more in an axial direction of the heating rotator and passing through the fixing nip and a second recording medium having a length less than the predetermined length in the axial direction and passing through the fixing nip. The ejection guide includes a first ejection guide and a second ejection guide. The first ejection guide guides the first recording medium. The first ejection guide has an opening disposed corresponding to the center of the heating rotator. The second recording medium passes through the opening. The second ejection guide guides the second recording medium passing through the opening of the first ejection guide.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
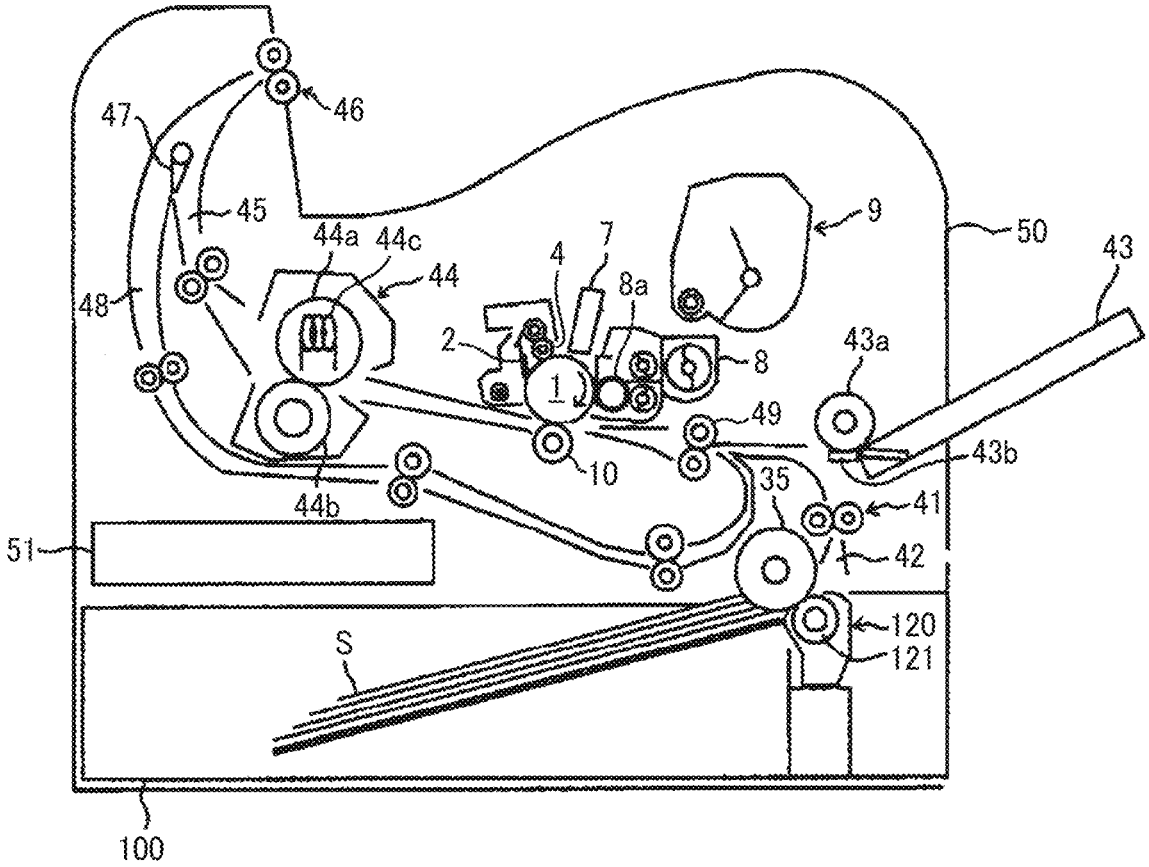
FIG. 1 is a schematic diagram illustrating an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

Now, an example of an electrophotographic printer that forms an image by electrophotography is described as an electrophotographic image forming apparatus according to an embodiment of the present disclosure.

At first, a description is given of a basic configuration of the image forming apparatus according to the embodiment of the present disclosure.

FIG. 1 is a schematic diagram illustrating a configuration of the image forming apparatus according to the embodiment of the present disclosure.

In FIG. 1, the image forming apparatus includes a housing 50, a photoconductor 1, and a sheet tray 100. The photoconductor 1 functions as an image bearer. The sheet tray 100 is detachably attachable to the housing 50. The sheet tray 100 contains a bundle of sheets S as recording media.

The sheet S in the sheet tray 100 is fed from the sheet tray 100 as a sheet feed roller rotates, passes through a sheet separation nip region, and reaches a sheet conveyance path 42. Thereafter, the sheet S is held by a first pair of sheet conveyance rollers 41 in a sheet conveyance nip region formed between rollers thereof and conveyed from an upstream side toward a downstream side in a sheet conveyance direction through the sheet conveyance path 42. A registration roller pair 49 is disposed at an end of the sheet conveyance path 42. When the sheet S reaches the registration roller pair 49, the sheet S is temporarily stopped in a state in which the leading end of the sheet S is in contact with the registration nip region of the registration roller pair 49. Abutting the leading end of the sheet S on the registration nip region corrects skew of the sheet S.

The registration roller pair 49 starts rotating to feed the sheet S to a transfer nip timely so that a toner image on the photoconductor 1 is transferred onto the sheet S in the transfer nip. At this time, the first pair of sheet conveyance rollers 41 starts rotating at the same time as the start of rotation of the registration roller pair 49 to resume the conveyance of the sheet S that is temporarily stopped.

The housing 50 of the image forming apparatus holds a bypass sheet feeder including a bypass tray 43, a bypass feed roller 43*a*, and a separation pad 43*b*. As the bypass feed roller 43*a* rotates, the sheet manually set on the bypass tray 43 is fed from the bypass tray 43. The separation pad 43*b* is disposed in contact with the bypass feed roller 43*a*, forming a separation nip. After passing through the separation nip between the bypass feed roller 43*a* and the separation pad 43*b*, the sheet enters a region upstream from the registration roller pair 49 in the sheet conveyance path 42 in the sheet conveyance direction. The sheet passes the registration roller pair 49 and reaches the transfer nip similar to the sheet S fed form the sheet tray 100.

The photoconductor 1 is a drum-shaped photoconductor that rotates in a clockwise direction in FIG. 1. Around the photoconductor 1, the image forming apparatus includes a charging roller 4, a latent image writing device 7, a developing device 8, a transfer roller 10, and a cleaning blade 2. The charging roller 4 rotates while contacting the photoconductor 1, thereby forming a charging nip. A power supply applies a charging bias to the charging roller 4. Thus, in the charging nip, an electrical discharge is induced between the surface of the photoconductor 1 and the surface of the charging roller 4. As a result, the surface of the photoconductor 1 is uniformly charged.

The latent image writing device 7 includes a light emitting diode (LED) array and performs light scanning with LED light over the surface of the photoconductor 1 that has been uniformly charged. On the uniformly charged surface of the photoconductor 1, the area having been subjected to the light irradiation through this light scanning attenuates the electric potential therein. Thus, an electrostatic latent image is formed on the surface of the photoconductor 1.

As the photoconductor 1 rotates, the electrostatic latent image passes through a developing range between the surface of the photoconductor 1 and the developing device 8. In the developing range, the developing device 8 supplies toner to the electrostatic latent image formed on the photoconductor 1, visualizing the electrostatic latent image as a toner image.

A toner cartridge 9 is disposed above the developing device 8. A toner cartridge 9 contains fresh toner to be supplied. Toner is supplied to the developing device 8 according to a toner supply operation signal output from a controller 51.

The toner image formed on the surface of the photoconductor 1 as a result of the development by the developing device 8 enters the transfer nip where the photoconductor 1 and the transfer roller 10 contact each other along with rotation of the photoconductor 1. An electric bias having the opposite polarity to the latent image electric potential of the photoconductor 1 is applied to the transfer roller 10 to form a transfer electric field in the transfer nip.

As described above, the registration roller pair 49 conveys the sheet S toward the transfer nip in synchrony with a timing at which the toner image formed on the photoconductor 1 is overlaid onto the sheet S in the transfer nip. Due to the transfer electric field and the nip pressure, as the sheet S is brought to closely contact with the toner image formed on the photoconductor 1 at the transfer nip, the toner image is transferred onto the sheet S.

Residual toner that is not transferred onto the sheet S remains on the surface of the photoconductor 1 after having passed through the transfer nip. The cleaning blade 2 is in contact with the photoconductor 1 to scrape off the residual toner from the surface of the photoconductor 1 and clean the surface of the photoconductor 1.

The surface of the photoconductor 1 that is cleaned by the cleaning blade 2 is electrically discharged by an electric discharging device. Thereafter, the surface of the photoconductor 1 is uniformly charged again by the charging roller 4.

The sheet S, which has passed through the transfer nip formed by the photoconductor 1 and the transfer roller 10 contacting each other, is conveyed to a fixing device 44. The fixing device 44 includes a fixing roller 44*a* and a pressure roller 44*b*. The fixing roller 44*a* serves as a heating rotator and includes a heater 44*c* such as a halogen lamp. The pressure roller 44*b* serves as a nip formation rotator and is pressed against the fixing roller 44*a*. The fixing roller 44*a* and the pressure roller 44*b* contact each other to form a fixing nip.

The fixing roller 44*a* includes a hollow core made of metal such as stainless steel or aluminum and a release acceleration layer covering an outer peripheral surface of the core to improve releasability of toner and paper powder from the surface of the fixing roller 44*a*. The pressure roller 44*b* includes a core made of metal such as stainless steel or aluminum and an elastic layer on an outer surface of the core. The elastic layer is made of material having elasticity and heat resistance such as fluoro-rubber or silicone rubber.

The toner image is fixed to the surface of the sheet S that is held in the fixing nip due to application of heat and pressure. Thereafter, the sheet S that has passed through the fixing device 44 passes through a sheet ejection path 45. Then, the sheet S is held in a sheet ejection nip formed by a pair of sheet ejection rollers 46.

The image forming apparatus switches printing modes between a single-side printing mode for performing single-side printing and a duplex printing mode for performing duplex printing. In the single-side printing mode, the image forming apparatus produces an image on one side of the sheet S. By contrast, the image forming apparatus prints respective images on both sides of the sheet S in the duplex printing mode. In the single-side printing mode or in the duplex printing mode after images are formed on both sides of the sheet S, the pair of sheet ejection rollers 46 continues rotating in a forward direction. As a result, the sheet S in the sheet ejection path 45 is ejected out of the image forming apparatus. After passing through the fixing device 44, the sheet S is stacked on a sheet stacker provided on the top face of the housing 50 of the image forming apparatus.

By contrast, in the duplex printing mode when an image is formed on one side of the sheet S, the pair of sheet ejection rollers 46 is rotated in the reverse direction at the timing at which the end of the recording sheet S enters the sheet ejection nip of the pair of sheet ejection rollers 46. At this time, a switching claw 47 disposed near the downstream end of the sheet ejection path 45 moves to block (close) the sheet ejection path 45 and open an entrance of a reverse conveyance path 48 at the same time. As the sheet S starts reversing by the reverse rotation of the pair of sheet ejection rollers 46, the sheet S is conveyed to the reverse sheet conveyance path 48. In the reverse sheet conveyance path 48, the sheet is conveyed while being vertically reversed and then conveyed to the registration nip of the registration roller pair 49 again. Then, after a toner image has been formed on the other side of the sheet S in the transfer nip, the sheet S passes through the fixing device 44, the sheet ejection path 45, and the pair of sheet ejection rollers 46 and is then ejected to the outside of the housing 50 of the image forming apparatus.

When the fixing device 44 fixes the toner image onto the sheet S, the sheet S is subjected to high temperature. Under the high temperature, moisture in the sheet evaporates. Evaporation of the moisture can cause a so-called end curl in which an end of sheet in a width direction of the sheet curls depending on the grain of sheet. In particular, the end curl is likely to occur in the case that the sheet is a large sheet of plain paper.

Figure 2:
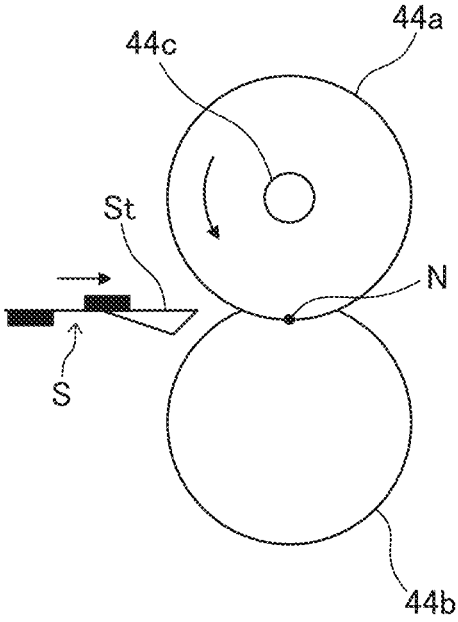
FIG. 2 is a schematic diagram illustrating a sheet having an end curl that is about to enter a fixing nip.

FIG. 2 is a schematic diagram illustrating the sheet S having the end curl St that is about to enter the fixing nip N.

While the image forming apparatus prints respective images on both sides of the sheet S, the end curl St can occur when the fixing device 44 fixes the toner image formed on the one side of the sheet S onto the sheet S. After the occurrence of the end curl, the sheet having the end curl enters the fixing nip N as illustrated in FIG. 2 when the fixing device 44 fixes the toner image formed on the other side of the sheet S onto the sheet S.

Figure 3:
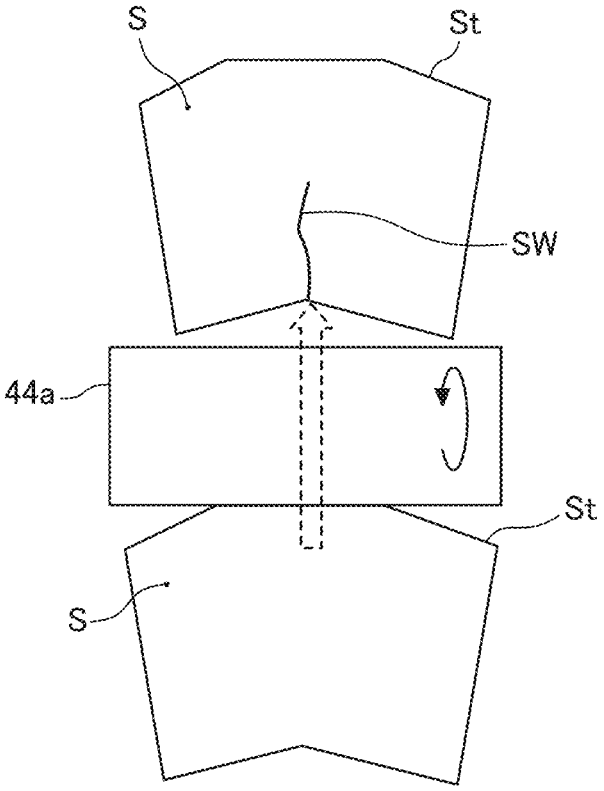
FIG. 3 is a schematic diagram illustrating the sheet having the end curl during entering the fixing nip and the sheet having the end curl after being ejected from the fixing nip.

FIG. 3 is a schematic diagram illustrating the sheet S having the end curl St during entering the fixing nip N and the sheet S having the end curl St after being ejected from the fixing nip N.

When the sheet having the end curl St enters the fixing nip N, the center portion of the sheet S in the width direction initially enters the fixing nip N as illustrated in FIG. 3. That is, the positions of both ends of the sheet S are shifted from the center of the sheet S in the sheet conveyance direction when the sheet enters the fixing nip N. Then, a trailing end of the sheet is bent in the width direction and enters the fixing nip N. In the fixing nip N, the bent trailing end of the sheet is crushed. As a result, a vertical crease SW occurs in the trailing end portion of the sheet S in the sheet conveyance direction as illustrated in FIG. 3.

Figure 4:
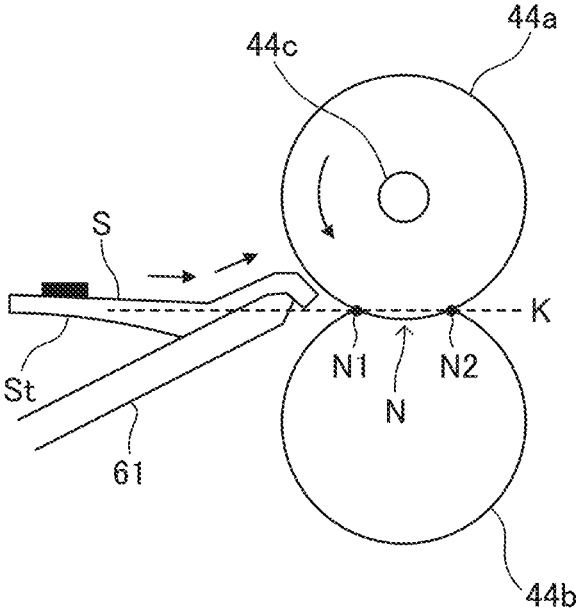
FIG. 4 is a schematic diagram illustrating a configuration for guiding the sheet toward a fixing roller.

To prevent the occurrence of the vertical crease SW, an entry guide 61 is disposed as illustrated in FIG. 4 to guide the sheet toward the fixing roller 44*a*. A downstream end of the entry guide 61 in the sheet conveyance direction is positioned in an area from the reference line K toward the fixing roller 44*a*. The reference line K is a straight line passing through an entry N1 and an exit N2 of the fixing nip N.

When the entry guide 61 guides the sheet toward the fixing roller 44*a*, the leading end of the sheet in the sheet conveyance direction abuts on the outer peripheral surface of the fixing roller 44*a* and then moves toward the fixing nip N while the leading end is pressed against the outer peripheral surface of the fixing roller 44*a*. Pressing the leading end of the sheet in the sheet conveyance direction against the fixing roller 44*a* as described above reduces the curl of the leading end portion of the sheet, and the sheet enters the fixing nip N. As a result, the leading edge of the sheet over the width direction can enter the fixing nip at substantially the same timing, preventing the occurrence of the vertical crease SW (hereinafter referred to as creases on plain paper printed on both sides) in the trailing end portion of the sheet in the sheet conveyance direction during the duplex printing mode.

Guiding the sheet S toward the pressure roller 44*b* and pressing the leading end of the sheet S against the pressure roller 44*b* can also reduce the end curl of the leading end portion of the sheet and enter the sheet to the fixing nip. However, pressing the leading end of the sheet S against the pressure roller 44*b* to enter the fixing nip may cause the following disadvantage. The fixing roller 44*a* does not have an elastic layer, but the pressure roller 44*b* has the elastic layer. Accordingly, the pressure roller 44*b* is softer than the fixing roller 44*a*. When the pressure roller 44*b* is brought into contact with the fixing roller 44*a* to form the fixing nip, the pressure roller 44*b* is elastically deformed. As a result, the fixing nip N has a shape along the outer peripheral surface of the fixing roller 44*a*, in other words, the shape recessed toward the pressure roller 44*b*. This means that guiding the sheet S toward the pressure roller 44*b* and pressing the leading end of the sheet S against the pressure roller 44*b* to reduce the end curl of the leading end portion of the sheet and enter the sheet to the fixing nip causes a rapid change of the sheet conveyance direction when the sheet enters the fixing nip. The sheet may not smoothly enter the fixing nip N, a sheet jam may occur, and the leading end of the sheet may be folded. Accordingly, it is preferable that the entry guide 61 guides the sheet toward the fixing roller 44*a* that is harder than the pressure roller 44*b* as illustrated in FIG. 4.

However, in the case that the sheet S is an envelope, the configuration illustrated in FIG. 4 has a risk that the vertical crease (hereinafter referred to as an envelope crease) may occur in the trailing end portion of the envelope in the conveyance direction.

The present inventors examined the relation between an entry guide angle β, an ejection guide angle γ, and the envelope crease using the image forming apparatus.

The test conditions were as follows.

A fixing nip width: 2.5 mm.

A fixing temperature: 210° C.

A printing speed: 180 mm/s.

Four types of envelopes having basis weights of 70 g/m$^2$, 80 g/m$^2$, 90 g/m$^2$, and 100 g/m$^2$ were used. The size of the envelope having the basis weight of 70 g/m$^2$ was 90 mm×205 mm (Japanese typical envelope size: nanagata 4 gou). The sizes of envelopes having the basis weights of 80 g/m$^2$, and 100 g/m$^2$ were 120 mm×235 mm (Japanese typical envelope size: nanagata 3 gou). The size of the envelope having the basis weight 90 g/m$^2$ was 104.7 mm×241.3 mm (COM10). In each of these four types of envelopes, five envelopes were printed, and lengths of envelope creases were measured. An average of the lengths of envelope creases in each of four types of envelopes was calculated. In addition, an average value of the four average values of the four types of envelopes was calculated to evaluate how the entry guide angle and the ejection guide angle affects the envelope crease. Hereinafter, the average value of the four average values of the four types of envelopes is referred to as an average envelope crease length.

Figure 5:
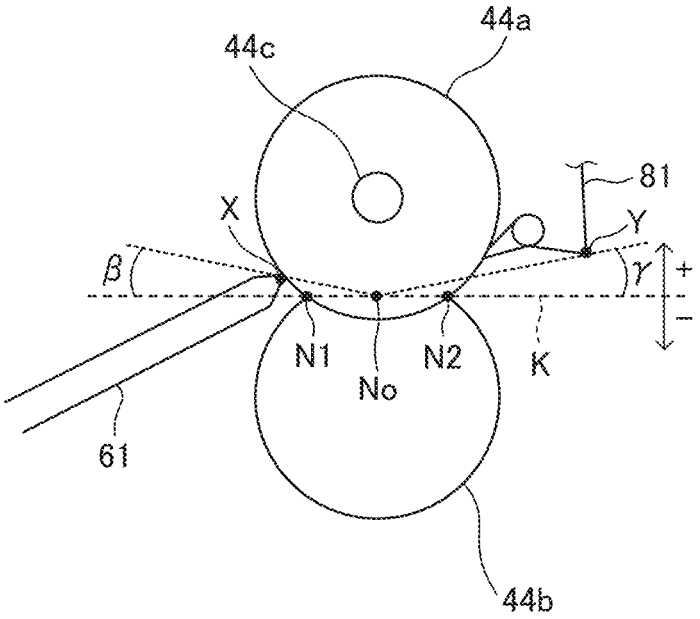
FIG. 5 is a schematic diagram illustrating definitions of an entry guide angle β and an ejection guide angle γ.

FIG. 5 is a schematic diagram illustrating the definition of the entry guide angle β and the ejection guide angle γ.

As illustrated in FIG. 5, the entry guide angle β is an angle formed by a reference line K passing through the entry N1 of the fixing nip N and the exit N2 of the fixing nip N and a line segment connecting the center No of the fixing nip N and the downstream end X of the entry guide 61 in the sheet conveyance direction. The center No of the fixing nip N is a center position between the entry N1 and the exit N2 of the fixing nip N on the reference line K.

The ejection guide angle γ is an angle formed between the reference line K and a line segment connecting the center No of the fixing nip N and a position Y closest to the fixing nip N among positions of an upper ejection guide 81 closest to the reference line K.

The angle β is positive in the case that the downstream end X is in an area including the fixing roller with respect to the reference line K (in other words, the area from the reference line K toward the fixing roller) and negative in the case that the downstream end X is in an area including the pressure roller with respect to the reference line K (in other words, the area from the reference line K toward the pressure roller). The angle γ is positive in the case that the position Y is in the area including the fixing roller with respect to the reference line K and negative in the case that the position Y is in the area including the pressure roller with respect to the reference line K.

Figure 6A:
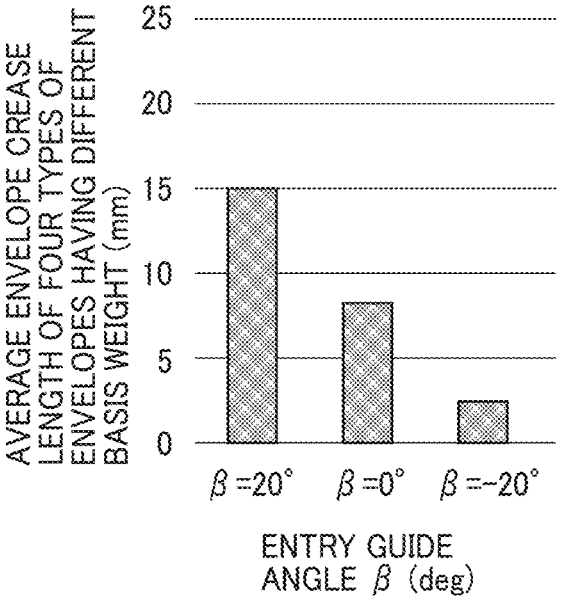
FIG. 6A is a graph illustrating a relation between average envelope crease length and the entry guide angle β.
Figure 6B:
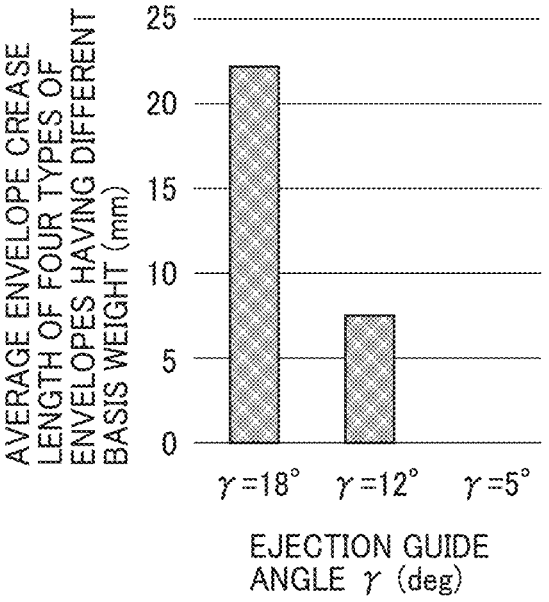
FIG. 6B is a graph illustrating a relation between the average envelope crease length and the ejection guide angle γ.

Table 1 below illustrates test results for the four types of envelopes having the basis weights of 70 g/m$^2$, 80 g/m$^2$, 90 g/m$^2$, and 100 g/m$^2$. FIG. 6A is a graph illustrating a relation between the average envelope crease length and the entry guide angle β. FIG. 6B is a graph illustrating a relation between the average envelope crease length and the ejection guide angle γ. Table 2 illustrates a relation between the average envelope crease length and a set of the entry guide angle β and the ejection guide angle γ based on table 1.

TABLE 1

| | | | Crease length in trailing end portion of back side in each of four types of envelopes (mm) with basis weights and sizes (mm) | | | | | Average |
|---|---|---|---|---|---|---|---|---|
| No | Entry guide angle β (deg) | Ejection guide angle γ (deg) | 70 g/m$^2$ 90 × 205 Thin envelope | 80 g/m$^2$ 120 × 235 Thin envelope | 90 g/m$^2$ 104.7 × 241.3 Typical thickness envelope | 100 g/m$^2$ 120 × 235 Thick envelope | Total crease length (mm) | crease length of four types of envelopes (mm) |
| 1 | 20 | 18 | 58 | 45 | 30 | 0 | 134 | 33.5 |
| 2 | 20 | 12 | 33 | 13 | 0 | 0 | 46 | 11.5 |
| 3 | 20 | 5 | 0 | 0 | 0 | 0 | 0 | 0 |
| 4 | 0 | 18 | 37 | 38 | 25 | 0 | 100 | 25 |
| 5 | 0 | 12 | 0 | 0 | 0 | 0 | 0 | 0 |
| 6 | 0 | 5 | 0 | 0 | 0 | 0 | 0 | 0 |
| 7 | −20 | 18 | 30 | 0 | 0 | 0 | 30 | 7.5 |
| 8 | −20 | 12 | 0 | 0 | 0 | 0 | 0 | 0 |
| 9 | −20 | 5 | 0 | 0 | 0 | 0 | 0 | 0 |

(The above data were obtained under the following conditions.

The fixing nip: 2.5 mm, The fixing temperature at the center: 210 deg, The fixing temperature at the end: 210 deg.)

TABLE 2

| | | Ejection guide angle γ (deg) | | | | |
|---|---|---|---|---|---|---|
| | | 18° | 12° | 5° | 0° | −10° |
| Entry guide angle β (deg) | 20 | 33.5 | 11.5 | 0 | 0 | 0 |
| | 0 | 25 | 0 | 0 | 0 | 0 |
| | −20 | 7.5 | 0 | 0 | 0 | 0 |

The average envelope crease length of four types of envelopes having different basis weights in β=20° of FIG. 6A is the average value calculated from the average crease lengths of four types of envelopes in No. 1 to No. 3 of Table 1. The average envelope crease length of four types of envelopes having different basis weights in β=0° of FIG. 6A is the average value calculated from the average crease lengths of four types of envelopes in No. 4 to No. 6 of Table 1. The average envelope crease length of four types of envelopes having different basis weights in β=−20° of FIG. 6A is the average value calculated from the average crease lengths of four types of envelopes in No. 7 to No. 9 of Table 1. In addition, the average envelope crease length of four types of envelopes having different basis weights in γ=18° of FIG. 6B is the average value calculated from the average crease lengths of four types of envelopes in No. 1, No. 4, and No. 7 of Table 1. The average envelope crease length of four types of envelopes having different basis weights in γ=12° of FIG. 6B is the average value calculated from the average crease lengths of four types of envelopes in No. 2, No. 5, and No. 8 of Table 1. The average envelope crease length of four types of envelopes having different basis weights in γ=5° of FIG. 6B is the average value calculated from the average crease lengths of four types of envelopes in No. 3, No. 6, and No. 9 of Table 1.

As illustrated in FIGS. 6A and 6B and table 2, the envelope crease length decreases as the value of the entry guide angle β decreases regardless of the value of the ejection guide angle γ. In addition, the envelope crease length decreases as the value of the ejection guide angle γ decreases regardless of the value of the entry guide angle β.

As can be seen from Table 2, when the ejection guide angle γ is 12° or less, and the entry guide angle is at least 0° or less, the envelope crease did not occur. As a result, setting the entry guide angle β to 0° or less and the ejection guide angle γ to 12° or less is preferable regarding the envelope crease.

The following describes the occurrence of envelope crease.

Figure 7:
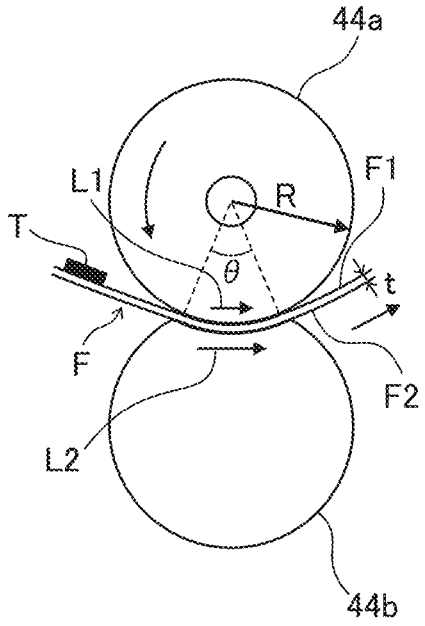
FIG. 7 is a schematic diagram illustrating an envelope passing through the fixing nip.
Figure 8A:
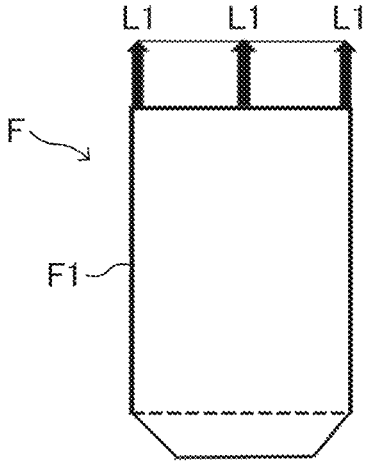
FIGS. 8A and 8B are schematic diagrams illustrating conveyance amount distributions of the envelope in the fixing nip.
Figure 8B:
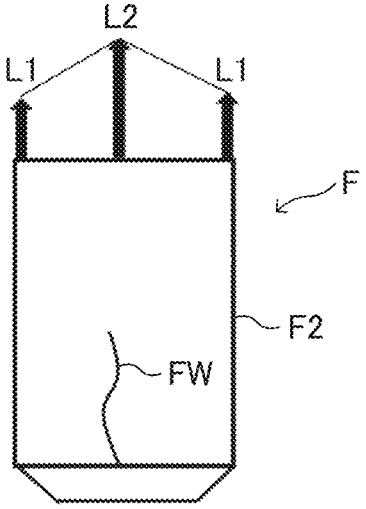

FIG. 7 is a schematic diagram illustrating the envelope F passing through the fixing nip N, and FIGS. 8A and 8B are schematic diagrams illustrating conveyance amount distributions in both sides of the envelope F in the fixing nip. FIG. 8A is a schematic diagram illustrating the conveyance amount distribution of a printed sheet side F1 of the envelope F at the fixing nip N. The printed sheet side F1 is an envelope portion that includes a printed surface of the envelope F and is in contact with the outer circumferential surface of the fixing roller 44*a*. FIG. 8B is a schematic diagram illustrating the conveyance amount distribution of a non-printed sheet side F2 of the envelope F at the fixing nip N. The non-printed sheet side F2 is an envelope portion not including the printed surface of the envelope F and is in contact with the outer circumferential surface of the pressure roller 44*b*.

As described above, the pressure roller 44*b* is softer than the fixing roller 44*a* and elastically deforms in the fixing nip N. As a result, the fixing nip N curves with the curvature of the fixing roller 44*a*. As illustrated in FIG. 7, a conveyance amount L1 of a widthwise central portion of the printed sheet side F1 of the envelope F at the fixing nip N is expressed by (2πθ/360) R where θ is an angular range around the rotation center of the fixing roller 44*a* in the fixing nip N, and R is the radius of the fixing roller 44*a*. A conveyance amount L2 of a widthwise central portion of the non-printed sheet side F2 at the fixing nip is expressed by (2πθ/360) (R+t) where t is the thickness of the envelope, and other symbols are the same meaning as the above. In the fixing nip N, the conveyance amount of the widthwise central portion of the printed sheet side F1 is different from the conveyance amount of the widthwise central portion of the non-printed sheet side F2.

The envelope F has two layers of sheets formed by folding a sheet and gluing both ends of the sheet in the width direction or gluing both ends of two sheets overlaid. Accordingly, in the width direction of the envelope F, both ends of the non-printed sheet side F2 moves together with both ends of the printed sheet side F1. As a result, the difference of conveyance amounts does not generate between the sheet sides F1 and F2 at both ends of the envelope. In contrast, the widthwise central portion of the non-printed sheet side F2 of the envelope F is movable relative to the widthwise central portion of the printed sheet side F1 in the sheet conveyance direction. The above-described difference in the conveyance amounts L1 and L2 in the fixing nip N generates a displacement in the sheet conveyance direction between the widthwise central portion of the non-printed sheet side F2 and the widthwise central portion of the printed sheet side F1. The displacement generates the crease FW in the trailing end portion of the envelope.

When the entry guide angle β is positive, the envelope is conveyed along the outer circumferential surface of the fixing roller 44*a* and enters the fixing nip N. Accordingly, before the envelope enters the fixing nip N, the conveyance amount of the widthwise central portion of the non-printed sheet side F2 becomes larger than that of the widthwise central portion of the printed sheet side F1. As a result, the displacement in the sheet conveyance direction between the widthwise central portion of the non-printed sheet side F2 and the widthwise central portion of the printed sheet side F1 increases, and the envelope crease lengthens. In contrast, when the entry guide angle β is negative, the envelope F bends toward the pressure roller 44*b* and enters the fixing nip N. In other words, the envelope F has a curve (convex toward the fixing roller) opposite to the curvature of the fixing nip N (concave toward the pressure roller). As a result, immediately before the envelope enters the fixing nip N, the conveyance amount of the widthwise central portion of the non-printed sheet side F2 is smaller than the conveyance amount of the widthwise central portion of the printed sheet side F1. As a result, the displacement of the widthwise central portion of the non-printed sheet side F2 with respect to the widthwise central portion of the printed sheet side F1 immediately before the envelope enters the fixing nip is shifted in the sheet conveyance direction to be opposite to the displacement of the widthwise central portion of the non-printed sheet side F2 with respect to the widthwise central portion of the printed sheet side F1 in the fixing nip, preventing the occurrence of the envelope crease.

Figure 9:
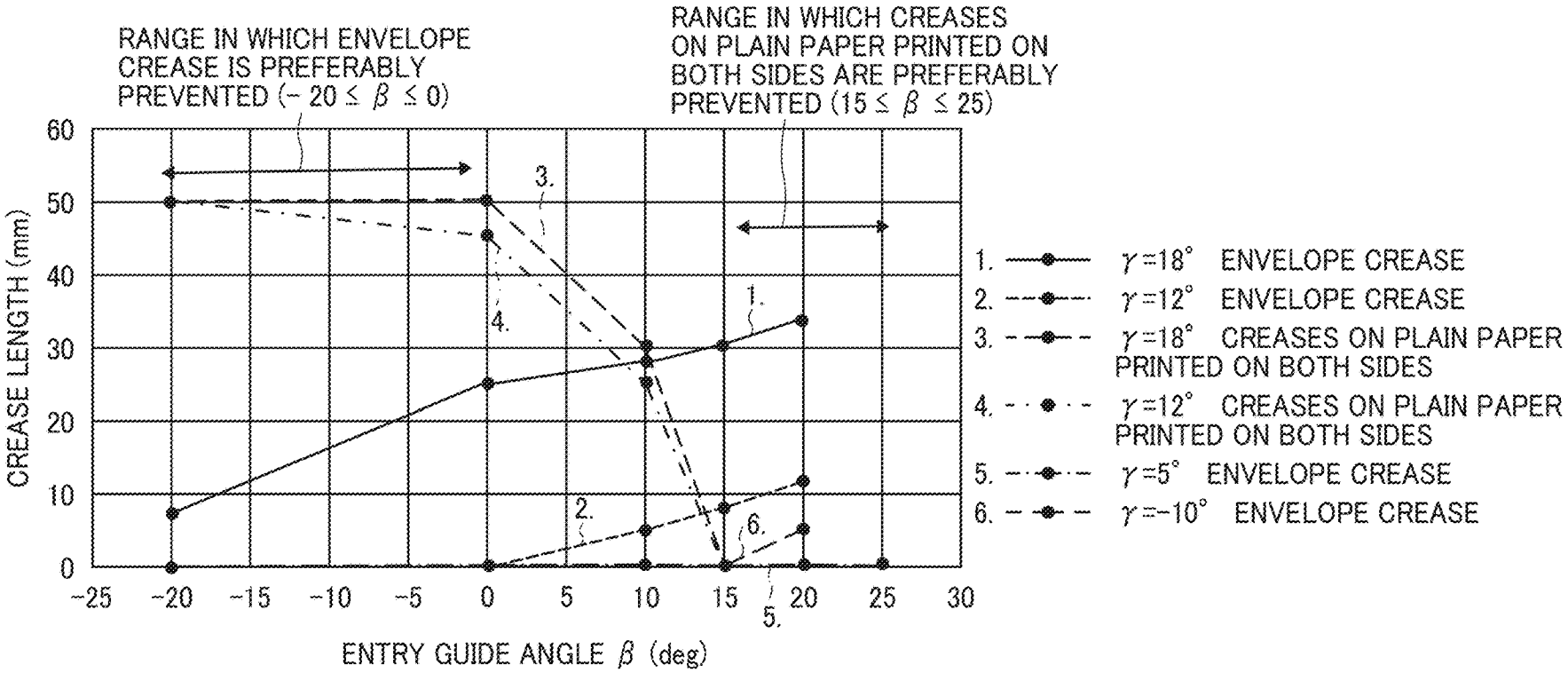
FIG. 9 is a graph illustrating results of experiments that examined relations between the entry guide angles 13, the ejection guide angles γ, the average envelope crease lengths, and creases on plain paper printed on both sides.

FIG. 9 is a graph illustrating results of experiments that examined relations between the entry guide angle β, the ejection guide angle γ, the envelope crease length, and the creases on plain paper printed on both sides.

The experiment conditions for creases on plain paper printed on both sides were as follows. The nip width:7.7 mm. The fixing temperature: 170° C. The printing speed: 252 mm/s. The basis weight of plain paper was 69 g/m$^2$.

As can be seen from a dashed line No. 3 and an alternate long and short dash line No. 4 in the graph of FIG. 9, increasing the entry guide angle β prevents the occurrence of the creases on plain paper printed on both sides, and setting the entry guide angle β to be 15° or more can avoid the occurrence of the creases on plain paper printed on both sides.

When the entry guide angle β is negative, the envelope moves along the outer peripheral surface of the pressure roller 44*b* and enters the fixing nip depending on the inclination of the entry guide 61. However, as described above, the fixing nip is set to be 2.5 mm during printing the envelope to reduce the elastic deformation amount of the pressure roller 44*b*. The above-described configuration prevents the rapid change of the sheet conveyance direction when the envelope moves along the outer peripheral surface of the pressure roller 44*b* and enters the fixing nip. Accordingly, the above-described configuration can convey the envelope without causing the problems such as the sheet jam or folding the leading end.

Based on the above, the entry guide angle β is preferably 0° or less to convey the envelope but preferably positive when both sides of the sheet of plain paper are printed. As described above, the optimum entry guide angle β is different between the conveyance of the sheet of the plain paper and the conveyance of the envelope. It may be considered that the entry guide 61 configured to be rotatable changes the orientation of the entry guide 61 to switch between the direction for guiding the conveyance of the sheet of the plain paper and the direction for guiding the conveyance of the envelope. However, the above-described configuration needs a mechanism for rotating the entry guide and increases the number of components, and the device configuration becomes complicated, which may lead to an increase in cost of the device.

In the present embodiment, the entry guide 61 includes a first entry guide portion to guide the large sheet of plain paper and a second entry guide portion to guide the envelope. The entry guide 61 is fixed to the device but guides the envelope and the large sheet of plain paper toward different directions, respectively. Next, a detailed description is given of the fixing device according to a first embodiment, with reference to the drawings.

First Embodiment

Figure 10:
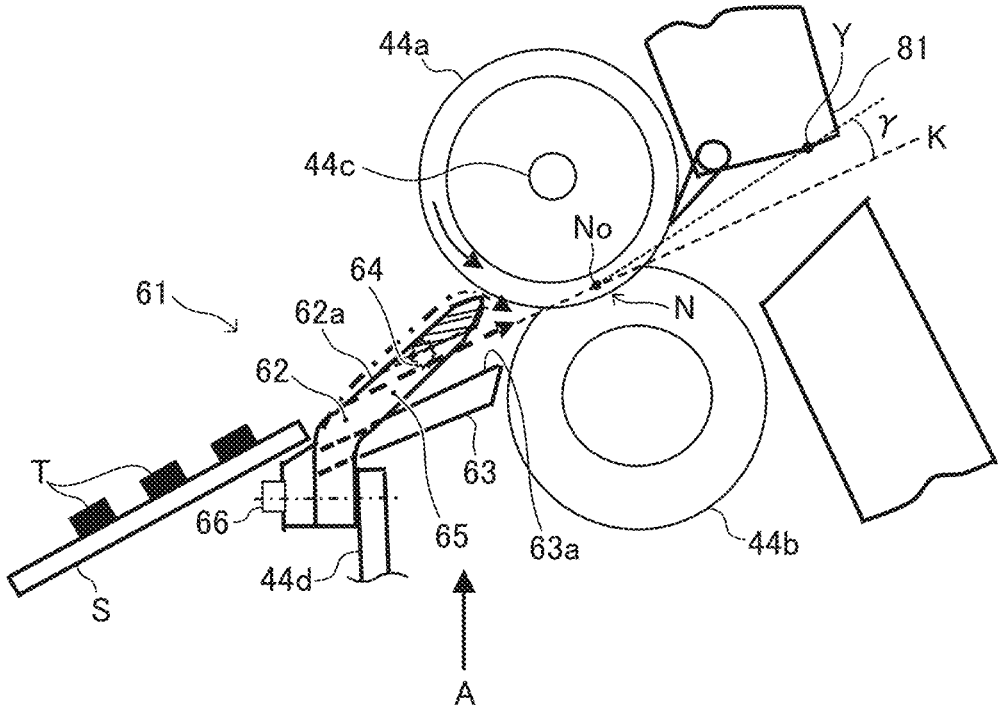
FIG. 10 is a schematic diagram illustrating a configuration of a fixing device according to a first embodiment.
Figure 11:
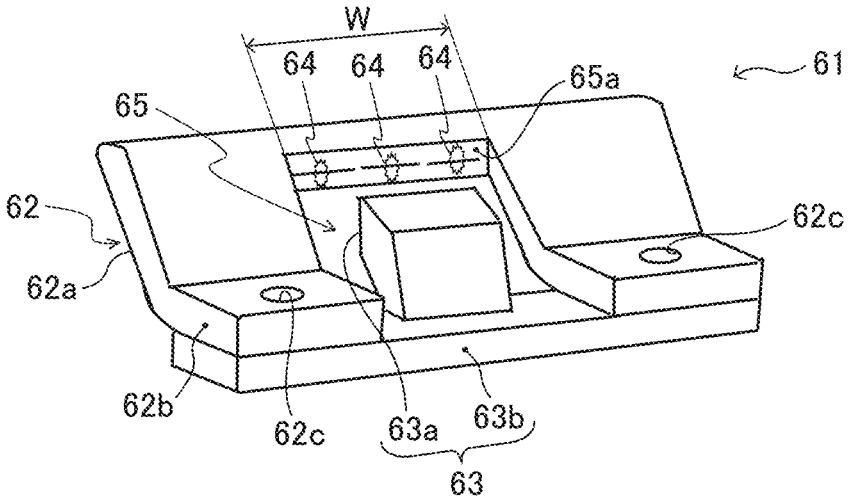
FIG. 11 is a perspective view of an entry guide according to the first embodiment seen from a direction indicated by arrow A in FIG. 10.

FIG. 10 is a schematic diagram illustrating a configuration of the fixing device according to the first embodiment. FIG. 11 is a perspective view of the entry guide 61 according to the first embodiment seen from a direction indicated by arrow A in FIG. 10.

The entry guide 61 of the present embodiment includes a first member 62 and a second member 63. The first member 62 includes a first attachment portion 62*b* that is attached to a case side plate 44*d* of the fixing device 44 and a first entry guide portion 62*a* that guides the sheet S having a predetermined size or more. The first entry guide portion 62*a* extends obliquely upward from the first attachment portion 62*b* and downstream in the sheet conveyance direction from the first attachment portion 62*b*. The widthwise center portion of the first member 62 is cut out from an upstream end portion of the first member 62 in the sheet conveyance direction to form a space in the first entry guide portion 62*a* so that a sheet having a size smaller than a predetermined size passes through the space. The first attachment portion 62*b* has through holes 62*c* in both end portions in the width direction as illustrated in FIG. 11 so that screws 66 pass through the through holes 62*c*, respectively.

The second member 63 includes a second attachment portion 63*b* that is attached to the first member 62 and a second entry guide portion 63*a* that guides the sheet having a predetermined width or less. The second attachment portion 63*b* is a long plate extending in the width direction and being under both sides of the first attachment portion 62*b* in the width direction. The second entry guide portion 63*a* projects and extends downstream in the sheet conveyance direction from a center portion of the second attachment portion 63*b* in the width direction. The second attachment portion 63*b* has through holes in both end portions in the width direction so that screws 66 pass through the through holes, respectively.

The screws 66 pass through the through holes of the first attachment portion 62*b* and the through holes of the second attachment portion 63*b* and are screwed to the case side plate 44*d* as illustrated in FIG. 10. Thus, the entry guide 61 is fixed to the case side plate 44*d*.

Combining the first member 62 and the second member 63 forms an opening 65 having a rectangular shape when viewed from the sheet conveyance direction. The width W of the opening 65 in FIG. 11 is determined in consideration of standard sizes of envelopes and standard sizes of sheets of plain paper that can be conveyed by the image forming apparatus, which is described below. At least, the width W is larger than the widths of standard sizes of envelopes that can be conveyed by the image forming apparatus. Therefore, the envelope passes through the opening 65 and enters the fixing nip N while being guided by the second entry guide portion 63*a*.

A plurality of spur rollers 64 are rotatably disposed near a facing surface 65*a* of the first member 62. The facing surface 65*a* faces the printed surface of the sheet guided by the second entry guide portion 63*a* and passing through the opening 65. The spur rollers 64 prevent the printed surface of the sheet S on which the toner image is formed from rubbing against the facing surface 65*a* forming the opening 65, preventing the toner image formed on the printed surface from disturbing.

Figure 12:
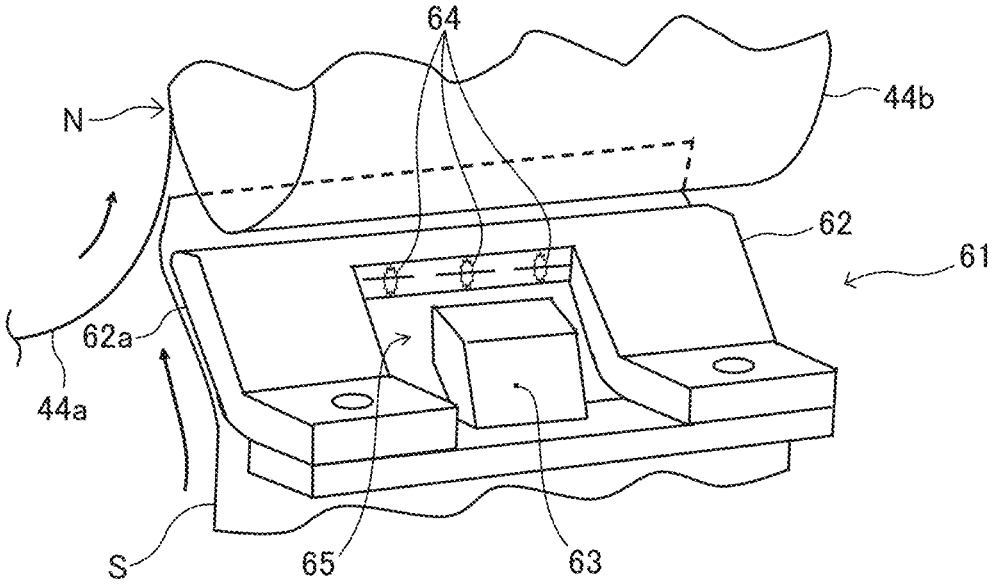
FIG. 12 is a schematic view of the entry guide of FIG. 11 guiding a large sheet of plain paper.

FIG. 12 is a schematic view of the entry guide 61 guiding the large sheet of plain paper having a width larger than the width W of the opening 65.

The large sheet of plain paper having the width larger than the width W of the opening 65 does not pass through the opening 65 and is guided by the first entry guide portion 62*a* and conveyed. In the present embodiment, the width W of the openings 65 is set between 148 mm (that is a width of A5 size) and 182 mm (that is a width of B5 size), which is described below. Accordingly, the large sheet of plain paper in the present embodiment has the width equal to or larger than the width of B5 size.

As illustrated in FIG. 10, the downstream end of the first entry guide portion 62*a* in the sheet conveyance direction is in the area including the fixing roller with respect to the reference line K. Therefore, the first entry guide portion 62*a* guides the large sheet of plain paper toward the fixing roller 44*a*. As a result, the leading edge of the large sheet of plain paper is pressed against the surface of the fixing roller, moves along the outer peripheral surface of the fixing roller, and enters the fixing nip N.

Since the end curl is likely to occur in the large sheet of plain paper as described above, the creases on plain paper printed on both sides are likely to occur. However, in the present embodiment, pressing the leading edge of the large sheet of plain paper against the surface of the fixing roller reduces the end curl in the leading end of the sheet, and the sheet enters the fixing nip. As a result, the occurrence of the creases on the large sheet of plain paper printed on both sides is prevented.

Figure 13:
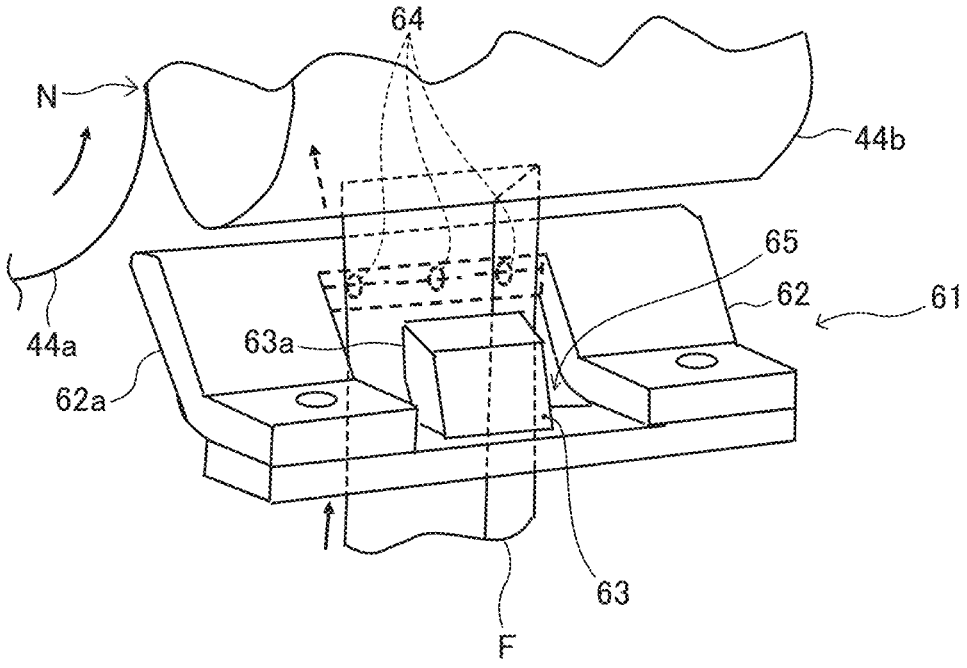
FIG. 13 is a schematic view of the entry guide of FIG. 11 guiding the envelop.

FIG. 13 is a schematic view of the entry guide 61 guiding the envelope.

As illustrated in FIG. 13, the envelope F passes through the opening 65, is guided by the second entry guide portion 63*a*, and is conveyed toward the fixing nip N.

As illustrated in FIG. 10, the downstream end of the second entry guide portion 63*a* in the sheet conveyance direction is in the area including the pressure roller 44*b* with respect to the reference line K. The lower end of the spur roller 64 is positioned on the reference line K. Accordingly, the second entry guide portion 63*a* guides the envelope F passing through the opening 65 in parallel with the reference line K or toward the pressure roller 44*b* from the reference line K to enter the fixing nip.

In other words, the second entry guide portion 63*a* guides the envelope F passing through the opening 65 at the entry guide angle β of 0° or less to enter the fixing nip N. As a result, the above-described configuration can reduce the envelope crease compared to the envelope guided by the first entry guide portion 62*a* to enter the fixing nip N.

In the fixing device 44, the ejection guide angle γ is set to be 12°. This setting can favorably reduce the envelope crease. Even when the ejection guide angle γ exceeds 12°, guiding the envelope at the entry guide angle β of 0° or less can reduce the envelope crease compared to guiding the envelope at the entry guide angle β of 20° as illustrated in Table 1 and FIG. 6.

The fixing device 44 includes the first entry guide portion 62*a* and the second entry guide portion 63*a*, and which guide guides the sheet depends on the width W of the opening 65. The above-described configuration enables the entry guide 61 fixed on the fixing device 44 to switch a guide direction between the envelope and the large sheet of plain paper. The entry guide 61 can be fixed on the fixing device 44 by a simple structure such as screwing. As a result, a cost of the above-described configuration is lower than a configuration in which the entry guide 61 is rotatably attached to the fixing device and switch the orientation of the entry guide between the envelope and the large sheet of plain paper to switch the guide direction.

In the present embodiment, a sheet of plain paper having a width equal to or smaller than the width W of the opening 65 is guided by the second entry guide portion 63*a* to enter the fixing nip N. When the image forming apparatus prints respective images on both sides of the sheet of plain paper having a width equal to or shorter than the width W of the opening 65, the leading end of the sheet is not pressed against the outer peripheral surface of fixing roller 44*a* to reduce the curl of the leading end portion of the sheet, and the sheet enters the fixing nip. However, since the amount of end curl increases in proportion to the width of the sheet, the end curl of the sheet of plain paper having a width equal to or shorter than the width W of the opening 65 is small. Accordingly, the occurrence of the creases on plain paper printed on both sides having the width equal to or shorter than the width W of the opening 65 is sufficiently prevented even if the leading end of the sheet of plain paper is not pressed against the outer peripheral surface of fixing roller 44*a* to reduce the end curl of the leading end portion of the sheet. When the sheet of plain paper having the width equal to or shorter than the width W of the opening 65 has a certain degree of end curl, the spur rollers 64 press the center portion of the sheet of plain paper in the width direction toward the second entry guide portion and reduce the end curl, and the sheet of plain paper enters the fixing nip N. Therefore, even when a certain degree of end curl occurs in the sheet of plain paper having the width equal to or shorter than the width W of the opening 65, the occurrence of the creases on plain paper printed on both sides can be prevented.

Fixing conditions for the sheet of plain paper having the width equal to or shorter than the width W of the opening 65 is preferably the same as the fixing conditions for the envelope. That is, the fixing nip width is 2.5 mm, the fixing temperature is 210° C., and the printing speed is 180 mm/s. The above-described conditions cause the elastic deformation of the pressure roller 44*b* to be smaller than that caused by the fixing conditions for plain paper (that is, the nip width: 7.7 mm, the fixing temperature: 170° C., the printing speed: 252 mm/s). As a result, the above-described conditions prevent the rapid change of the sheet conveyance direction when the sheet of plain paper having the width equal to or shorter than the width W of the opening 65 enters the fixing nip. Accordingly, the above-described configuration can convey the envelope without causing the problems such as the sheet jam or folding the leading end.

Figure 14:
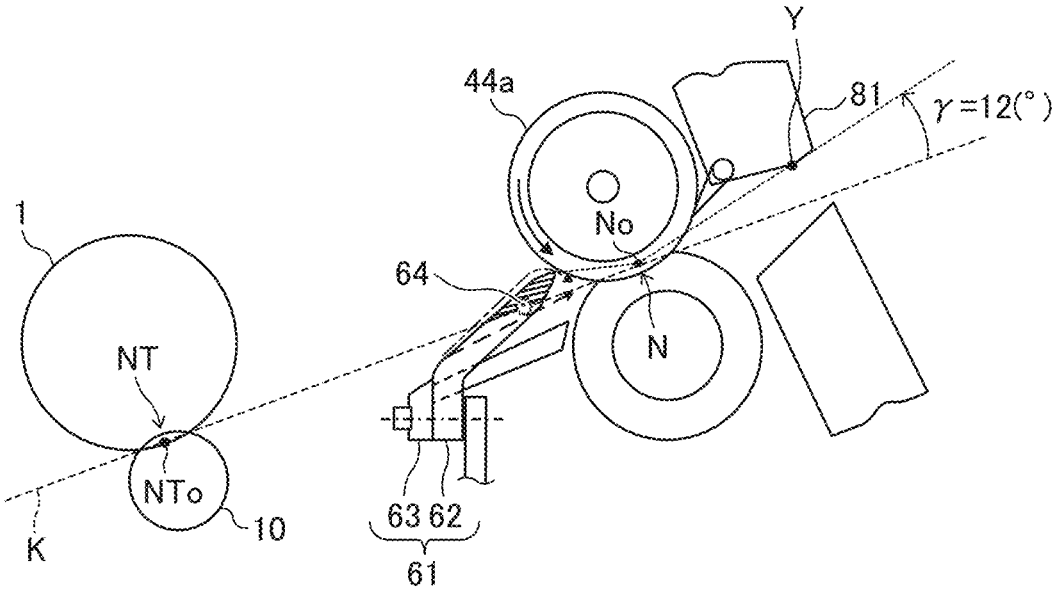
FIG. 14 is a diagram illustrating a positional relationship between a transfer nip and the fixing nip.

FIG. 14 is a diagram illustrating a positional relationship between the transfer nip NT and the fixing nip N.

In the present embodiment, a reference line of the transfer nip connecting the entry and the exit of the transfer nip NT coincides with the reference line K of the fixing nip connecting the entry and the exit of the fixing nip N, and a line connecting the center NTo of the transfer nip and the center No of the fixing nip coincides with the reference lines. The center NTo of the transfer nip is a center position between the entry and the exit of the transfer nip NT on the reference line of the transfer nip, and the center No of the fixing nip is a center position between the entry and the exit of the fixing nip on the reference line K of the fixing nip.

As described above, the lower end of the spur roller 64, which is a part closest to the second entry guide portion among facing parts around the opening 65 facing the printed surface of the recording medium, is located on the reference line K of the fixing nip. Accordingly, a line segment connecting the lower end of the spur roller 64 and the center of the fixing nip coincides with a line segment connecting the center NTo of the transfer nip and the center No of the fixing nip.

Since the positional relationship among the fixing nip, the transfer nip, and the lower end of the spur roller 64 is the above-described relationship, the sheet that has passed through the transfer nip does not largely change the direction in which the sheet is conveyed and enters the fixing nip. Thus, the image forming apparatus can be downsized.

Next, the width W of the opening 65 is described.

When a sheet has a width close to the width of the opening 65 and passes through the fixing device, the sheet may be caught by an end of the opening 65 in the width direction and may not be stably conveyed, which may cause a jam. Accordingly, the width W of the opening 65 is determined in consideration of the width of the sheet to be conveyed.

Table 3 below illustrates main standard-size sheets that can be conveyed by the image forming apparatus.

TABLE 3

| Standard sheet size Name | Sheet feeding Direction | Sheet Width (mm) | Sheet Length (mm) | Remarks |
|---|---|---|---|---|
| A4 | Short side feeding | 210 | 297 | |
| A5 | Short side feeding | 148 | 210 | |
| A5 | Long side feeding | 210 | 148 | |
| A6 | Short side feeding | 105 | 148 | |
| B5 | Short side feeding | 182 | 257 | |
| B6 | Short side feeding | 128 | 182 | |
| B7 | Short side feeding | 91 | 128 | |
| Legal | Short side feeding | 215.9 | 355.6 | |
| Letter | Short side feeding | 215.9 | 279.4 | |
| Half Letter | Short side feeding | 139.7 | 215.9 | |
| Half Letter | Long side feeding | 215.9 | 139.7 | |
| Postcard | Short side feeding | 100 | 148 | |
| Double postal card | Short side feeding | 148 | 200 | |
| Double postal card | Long side feeding | 200 | 148 | |
| Nanagata 3 gou | Short side feeding | 120 | 235 | Envelope |
| Nanagata 4 gou | Short side feeding | 90 | 205 | Envelope |
| Western-style No. 4 | Short side feeding | 105 | 235 | Envelope |
| Western-style No. 3 | Short side feeding | 98 | 148 | Envelope |
| DL | Short side feeding | 110 | 220 | Envelope |
| monarch | Short side feeding | 98 | 191 | Envelope |
| com10 | Short side feeding | 104 | 241 | Envelope |

The maximum width of the sheet that can be conveyed by the image forming apparatus is the width of the sheet having a letter size (=215.9 mm (8.5 inch)).

Figure 15:
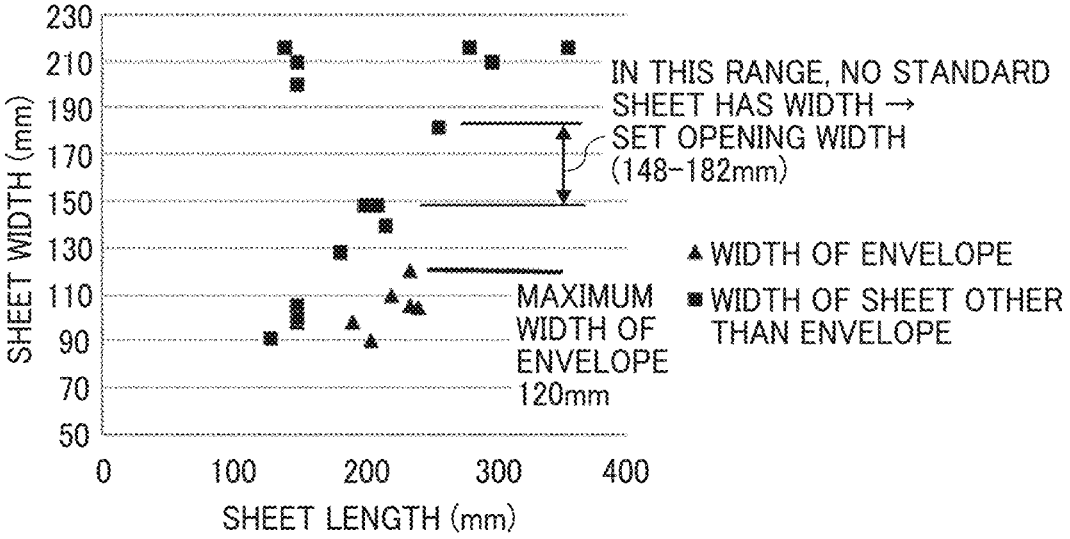
FIG. 15 is a graph illustrating sizes of sheets that can be conveyed by the image forming apparatus and having the horizontal axis that represents the sheet length and the vertical axis that represents the sheet width.

FIG. 15 is a graph illustrating sizes of sheets in the table 3 and having the horizontal axis that represents the sheet length and the vertical axis that represents the sheet width. In FIG. 15, black square marks are sizes of sheets of plain paper, and black triangle marks are sizes of envelopes. As can be seen from FIG. 15, since the maximum width of the envelope conveyed by the image forming apparatus is 120 mm, the width W of the opening 65 is set to 120 mm or more. Thus, the envelope conveyed by the image forming apparatus passes through the opening 65 and is guided by the second entry guide portion 63*a*.

As illustrated in FIG. 15, the standard-size sheets do not have a sheet width between 148 mm (that is the size of A5 sheet) and 182 mm (that is the size of B5). Accordingly, setting the width W of the opening 65 to be between 148 mm and 182 mm (for example, 160 mm) can prevent the sheet from being caught by the end of the opening 65 in the width direction and prevent the occurrence of a sheet jam.

As described above, setting the width W of the opening 65 to be between 148 mm and 182 mm can prevent the standard-size sheet from being caught by the end of the opening 65 in the width direction and prevent the occurrence of the sheet jam. Since the standard-size sheets are generally used in the image forming apparatus, the above-described configuration can sufficiently prevent the occurrence of the sheet jam. However, non-standard-size sheets may be used. When the sheet width of the non-standard-size sheet is in a range of 148 to 182 mm and is close to the width W of the opening 65, the sheet jam may occur. In addition, a non-standard-size envelope may be used in the image forming apparatus, and the width of the non-standard-size envelope may exceed the width W of the opening 65. In this case, the non-standard-size envelope does not pass through the opening 65 and is not guided by the second entry guide portion 63*a*. As a result, the envelope crease may occur.

To prevent the above, the entry guide 61 preferably has a configuration that can adjust the width W of the opening 65. The following describes the configuration of the entry guide 61 that can adjust the width W of the opening 65, as a second embodiment.

Second Embodiment

Figure 16:
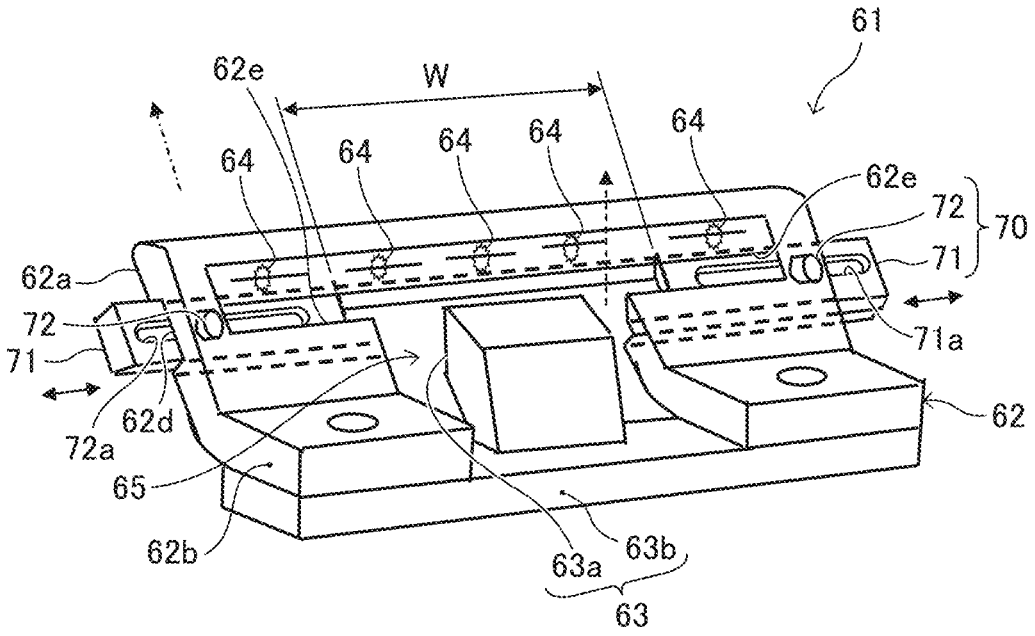
FIG. 16 is a schematic perspective view of the entry guide including an opening width adjuster according to a second embodiment.
Figure 17:
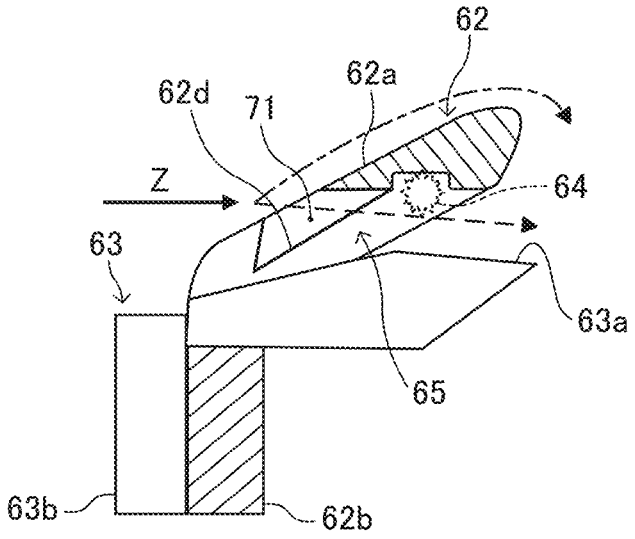
FIG. 17 is a schematic cross-sectional view of the entry guide including the opening width adjuster of FIG. 16.

FIG. 16 is a schematic perspective view of the entry guide including an opening width adjuster 70 serving as an entry opening width adjuster to adjust the width W of the opening 65. FIG. 17 is a schematic cross-sectional view of the entry guide including the opening width adjuster 70.

The opening width adjuster 70 includes a pair of opening width adjuster parts 71 and set screws 72. The pair of opening width adjuster parts 71 as entry opening width adjust members is attached to the entry guide 61 so as to be movable in the width direction. The set screws 72 fix the pair of opening width adjuster parts 71 at predetermined positions in the width direction.

The first entry guide portion 62*a* of the first member 62 forms a pair of extended openings 62*e* extending in the width direction. These extended openings 62*e* are formed on an entry path indicated by arrow Z in FIG. 17 that is a path of the sheet entering the entry guide. In addition, the first entry guide portion 62*a* has a pair of grooves 62*d* extending outside from the extended openings 62*e*. The pair of opening width adjuster parts 71 are attached to the grooves 62*d*, respectively so as to be slidable in the width direction. Screw holes are formed in the bottom surfaces of the grooves 62*d*.

Each of the pair of opening width adjuster parts 71 has a trapezoidal cross-sectional shape when viewed from the width direction, and the cross-sectional shape of the groove 62*d* and the cross-sectional shape of the extended opening 62*e* are trapezoidal shapes each of which is similar to the trapezoidal shape of the opening width adjuster part 71. Each of the opening width adjuster parts 71 has a screw through-hole 71*a* extending in the width direction. The set screw 72 is inserted into the screw through-hole 71*a* of the opening width adjuster part 71 and screwed into the screw hole formed in the groove 62*d*. As a result, the opening width adjuster part 71 is fixed on the first member 62.

When the width of the opening 65 is adjusted, loosening each set screw 72 enables each opening width adjuster part 71 to move in the width direction. Moving the pair of opening width adjuster parts 71 inward in the width direction narrows extended openings 62*e* in the opening 65 and narrows the width of the opening 65 to enter the sheet. In the above-described configuration, when the non-standard-size sheet passes through the transfer nip and enters the entry guide, both ends of the non-standard-size sheet in the width direction abut on the opening width adjuster parts 71 and are guided by the first entry guide portion 62*a*.

Moving the pair of opening width adjuster parts 71 outward in the width direction widens extended openings 62*e* in the opening 65 and widens the width of the opening 65 to enter the sheet. In the above-described configuration, when the non-standard-size envelope passes through the transfer nip and enters the entry guide, the non-standard-size envelope passes through the opening 65 and is guided by the second entry guide portion 63*a*.

Designing the width of the opening 65 to enter the sheet adjustable as described above prevents the non-standard-size sheet of plain paper from being caught by the end of the entry guide around the opening 65 in the width direction. In addition, the non-standard-size envelope pass through the opening 65 and is guided by the second entry guide portion 63*a*.

The above-described configuration adjusts the width of a portion of the opening 65 into which the sheet enters, but the width of the entire opening may be adjusted. The configuration that can adjust the width of the entire opening increases an allowable range of the deviation of the entry position in the direction orthogonal to the sheet conveyance direction, the entry position at which the sheet enters the entry guide. As a result, the configuration can favorably convey the non-standard-size sheet.

The screw through-hole 71*a* of the opening width adjuster part 71 in the above-described configuration is a long hole extending in the width direction but may be a plurality of screw through-holes disposed at predetermined intervals in the width direction. In the above-described configuration, a user puts a hand to the entry guide 61 to adjust the width of the opening 65. However, for example, the fixing device may include an operation mechanism including a rack and pinion mechanism or the like that is operated at a position different from the position of the entry guide 61 in the fixing device and moves the pair of opening width adjuster parts 71 in the width direction.

A driver such as a drive motor may automatically adjust the width of the opening. For example, the user operates a control panel in the image forming apparatus to input the width of the sheet to be passed, or an external device such as a personal computer inputs the width of the sheet to be passed. Based on the input width data, the controller controls the driver to move the pair of opening width adjuster parts 71 to predetermined positions in the width direction.

A guide direction in which the sheet ejected from the fixing nip is guided may be different between the sheet of plain paper and the envelope. As described above, decreasing the value of the ejection guide angle γ of the envelope favorably decreases the envelope crease. However, decreasing the value of the ejection guide angle γ may increase a so-called back curl in which the sheet of plain paper curls toward the non-printed surface of the sheet in the single side printing mode. Accordingly, changing the guide direction of the sheet of plain paper ejected from the fixing nip from the guide direction of the envelope ejected from the fixing nip is preferable because changing the guide angle can favorably reduce the envelope crease and the back curl of the sheet of plain paper in the single side printing mode.

Figure 18A:
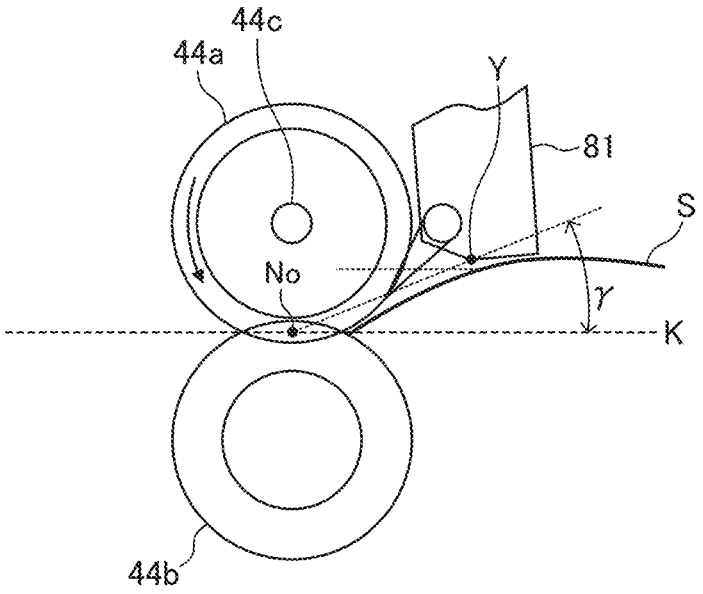
FIGS. 18A and 18B are schematic diagrams illustrating a back curl of the sheet of plain paper in the single side printing mode.
Figure 18B:
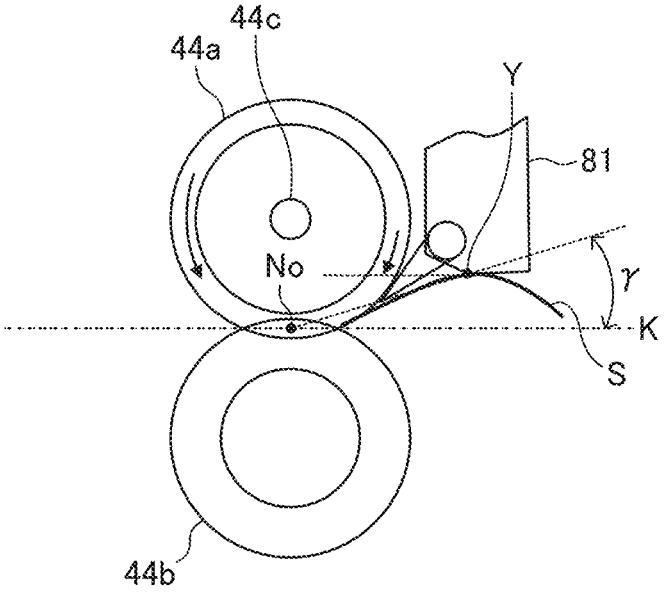

FIGS. 18A and 18B are schematic diagrams illustrating the back curl of the sheet of plain paper in the single side printing mode. FIG. 18A illustrates the sheet S ejected from the fixing nip when the ejection guide angle γ is set to be large. FIG. 18B illustrates the sheet S ejected from the fixing nip when the ejection guide angle γ is set to be small.

The position Y closest to the fixing nip N among positions of the upper ejection guide 81 closest to the reference line K in FIG. 18B is closer to the reference line K than the position Yin FIG. 18A. Accordingly, the ejection guide angle γ in FIG. 18B, which is the angle formed between the reference line K and the line connecting the center No of the fixing nip N and the position Y, is smaller than that in FIG. 18A.

Since the fixing nip N has a concave shape toward the pressure roller, the sheet S is ejected from the fixing nip N along the fixing roller, in other words, toward the upper ejection guide 81. The sheet ejected from the fixing nip N contacts the upper ejection guide 81 and changes a direction conveyed. When the ejection guide angle γ is small as illustrated in FIG. 18B, the sheet abuts on the upper ejection guide 81 before the sheet is bent by its own weight. Accordingly, a contact angle between the sheet and the upper ejection guide 81 in FIG. 18B is larger than that when the ejection guide angle γ is large as illustrated in FIG. 18A. As a result, when the ejection guide angle γ is small, the sheet is forcibly bent by the upper ejection guide 81, and a back curl amount of the sheet increases.

Figure 19:
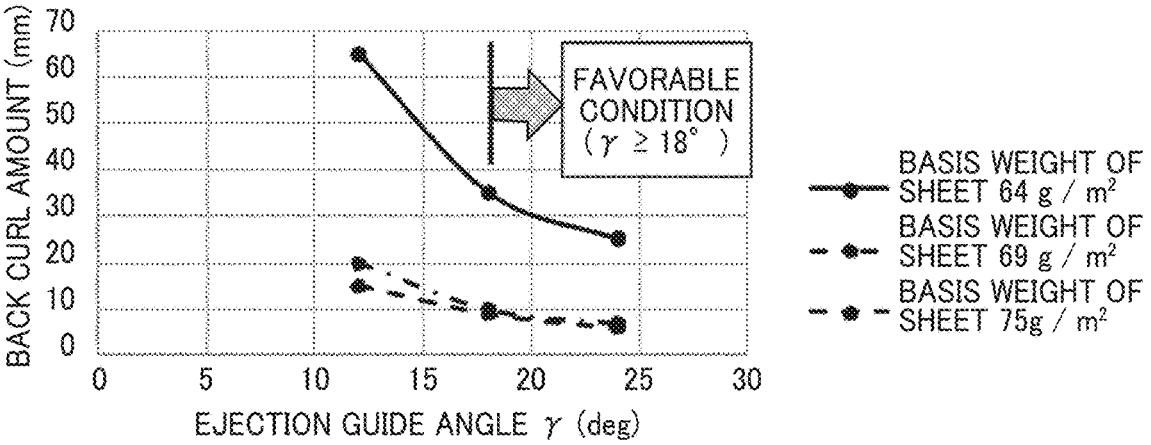
FIG. 19 is a graph illustrating a relation between the ejection guide angle γ and back curl amount of sheet of A4 size plain paper printed on one side.

FIG. 19 is a graph illustrating the relation between the ejection guide angles γ and the back curl amounts of sheets of A4 size plain paper printed on one side.

As illustrated in FIG. 19, as the ejection guide angle γ increased, the back curl amount decreased. The back curl amount of sheet with the basis weight of 64 g/m$^2$ rapidly decreased until the ejection guide angle γ was 18°, and the decrease in the back curl amount was small when the ejection guide angle γ was 18° or more. This means that setting the ejection guide angle γ to 18° or more can favorably decrease the back curl amount. In addition, when the ejection guide angle γ is 24° or less, the sheet was ejected from the fixing device without any problem. The above-described results mean that setting the ejection guide angle γ to be at least 18° or more and 24° or less decreases the back curl amount of the large sheet of plain paper and enables the conveyance of the large sheet of plain paper without problems.

Figure 20:
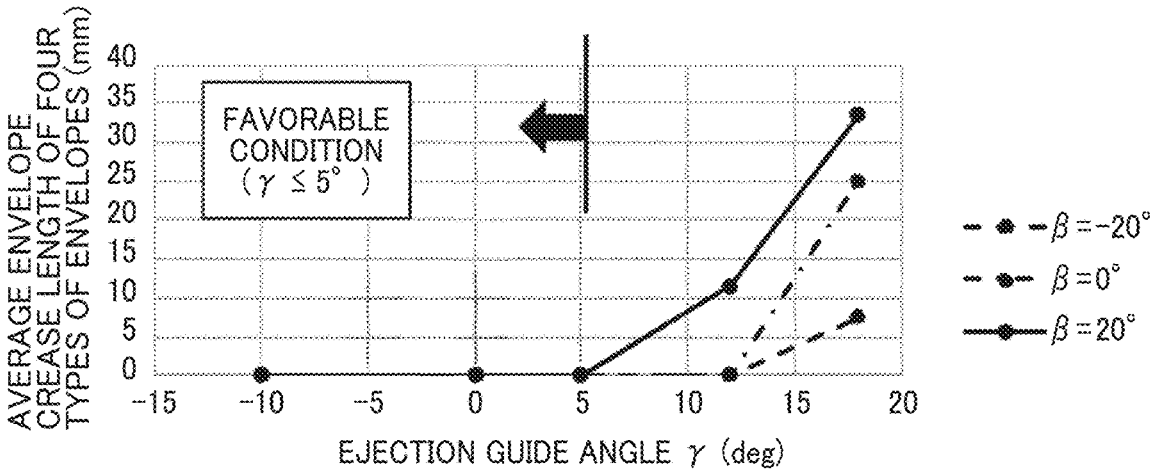
FIG. 20 is a graph illustrating the relation between the ejection guide angle γ and the envelope crease length.

FIG. 20 is a graph illustrating the relationship between the ejection guide angle γ and the envelope crease length.

FIG. 20 was made based on the results of Table 1 described above. As illustrated in FIG. 20, setting the ejection guide angle γ to 5° or less can prevent the occurrence of the envelope crease regardless of the value of the entry guide angle β. In addition, when the ejection guide angle γ was −10°, the envelope was satisfactorily ejected from the fixing device. The above-described results mean that setting the ejection guide angle γ to −10° or more and 5° or less can reduce the envelope crease and favorably eject the envelope from the fixing device.

The ejection guide angle γ that is less than zero means that the position Y of the upper ejection guide 81 is in the area including the pressure roller with reference to the reference line K. When the ejection guide angle γ is less than zero, the envelope ejected from the fixing nip immediately comes into contact with the upper ejection guide 81, and the upper ejection guide 81 guides the envelope so that the envelope is conveyed in the area including the pressure roller with respect to the reference line K.

Immediately after the envelope is ejected from the fixing nip at the small ejection guide angle γ, the envelope abuts on the upper ejection guide 81 and changes the direction conveyed toward the pressure roller. As a result, in the vicinity of the exit of the fixing nip, the envelope is bent to be convex toward the fixing roller, in other words, bent in a direction opposite to a direction bent in the fixing nip (the direction in which the envelope forms concave toward the pressure roller). The conveyance amount of the widthwise central portion of the non-printed sheet side F2 of the envelope is smaller than the conveyance amount of the widthwise central portion of the printed sheet side F1 at the exit of the fixing nip. As a result, the conveyance speed of the widthwise central portion of the non-printed sheet side F2 at the exit of the fixing nip is slower than the conveyance speed of the widthwise central portion of the printed sheet side F1, which reduces the displacement in the sheet conveyance direction between the widthwise central portion of the non-printed sheet side F2 and the widthwise central portion of the printed sheet side F1. Thus, the envelope crease is reduced.

As described above, the optimum ejection guide angle γ is different between the conveyance of the sheet of the plain paper and the conveyance of the envelope. Accordingly, the ejection guide preferably includes a first ejection guide that guides the large sheet of plain paper passing through the fixing nip and a second ejection guide that guides the envelope passing through the fixing nip. The following describes a fixing device including the ejection guide as a third embodiment.

Third Embodiment

Figure 21:
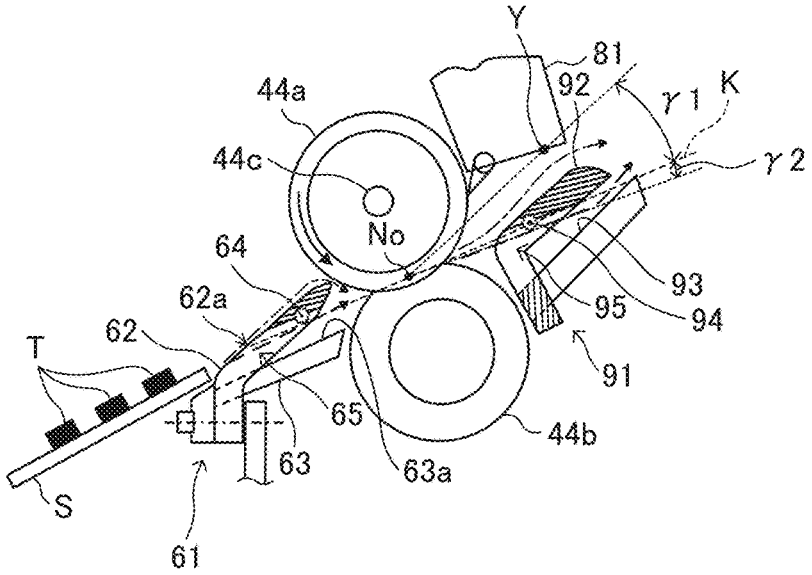
FIG. 21 is a schematic diagram illustrating the fixing device including an ejection guide according to a third embodiment.

FIG. 21 is a schematic diagram illustrating a configuration of the fixing device including an ejection guide 91.

The basic configuration of the ejection guide 91 is the same as that of the entry guide 61 and has an opening 95 through which the envelope passes. The ejection guide 91 includes a first ejection guide 92 that guides the sheet that does not pass through the opening 95 and a second ejection guide 93 that guides the sheet that passes through the opening 95. In addition, the ejection guide 91 includes a plurality of spur rollers 94 adjacent to a surface of the ejection guide 91 forming the opening 95 and facing the printed surface of the sheet passing through the opening 95, and the plurality of spur rollers 94 is disposed an upstream portion of the surface in the sheet conveyance direction.

An ejection guide angle γ1 in the first ejection guide 92 of the ejection guide 91 is set to 18° to 24°, and an ejection guide angle γ2 in the second ejection guide 93 is set to 5° to −10°. The ejection guide angle γ2 of the second ejection guide 93 is an angle formed by the reference line K and a line connecting the center No of the fixing nip and the lower end of the spur roller 94 at the position closest to the pressure roller in a portion facing the second ejection guide 93.

Figure 22:
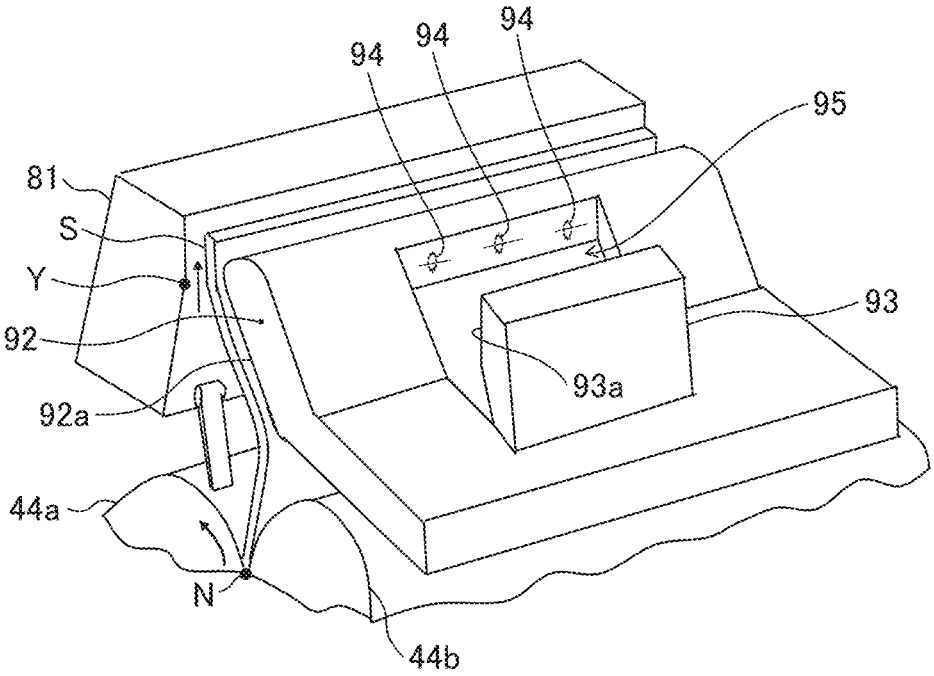
FIG. 22 is a schematic perspective view of the large sheet of plain paper ejected from the fixing nip and guided by a first ejection guide.

FIG. 22 is a schematic perspective view of the large sheet of plain paper ejected from the fixing nip N and guided by the first ejection guide 92.

As illustrated in FIG. 22, the large sheet of plain paper passes through the fixing nip N, is guided by the first ejection guide 92, and is ejected from the fixing device. The large sheet of plain paper abuts on the ejection guide and is conveyed immediately after passing through the fixing nip. The direction in which the large sheet of plain paper is conveyed is not changed toward the pressure roller. The above-described configuration can reduce the back curl of the large sheet of plain paper when the one side of the large sheet of plain paper is printed.

Figure 23:
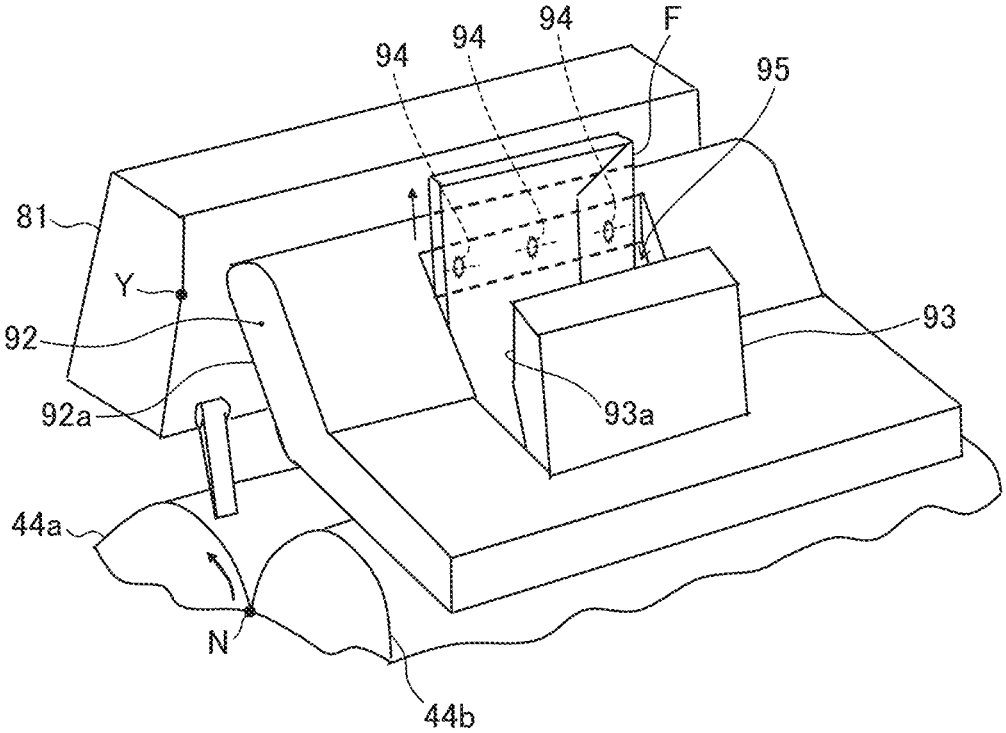
FIG. 23 is a schematic perspective view of the envelope ejected from the fixing nip and guided by a second ejection guide.

FIG. 23 is a schematic perspective view of the envelope ejected from the fixing nip and guided by the second ejection guide 93.

The width of the opening 95 is set to be equal to the opening 65 of the entry guide and is between 148 mm (that is the width of A5 size) and 182 mm (that is the width of B5 size). As described above, since the maximum size of the standard-size envelope conveyed by the image forming apparatus is 120 [mm], the envelope that has passed through the fixing nip enters the opening 95 and comes into contact with the spur rollers 94, and the conveyed direction is switched. Then, the envelope passing through the opening 95 is guided by the second ejection guide 93.

As described above, after the envelope passes through the fixing nip, the envelope enters the opening 95 and comes into contact with the spur rollers 94, so that the envelope is ejected while being prevented from rising toward the fixing roller. The above-described configuration prevents the conveyance speed of the widthwise central portion of the non-printed sheet side immediately after the envelope passes through the fixing nip from being faster than the conveyance speed of the widthwise central portion of the printed sheet side, which reduces the displacement at the fixing nip in the sheet conveyance direction between the widthwise central portion of the non-printed sheet side and the widthwise central portion of the printed sheet side. Thus, the envelope crease is reduced.

A small sheet of plain paper having a width smaller than the width of the opening 95 passes through the opening 95 and is ejected while being guided by the second ejection guide 93. The small sheet of plain paper having the width smaller than the width of the opening 95 also enters the opening 95 and comes into contact with the spur rollers 94 to switch the conveyed direction. However, since the spur rollers 94 rotate to receive the force when the small sheet of plain paper contacts the spur rollers 94, the spur rollers 94 prevent the small sheet of plain paper from bending toward the pressure roller and forming the back curl.

The ejection guide 91 may also include an opening width adjuster similar to the opening width adjuster 70 illustrated in FIG. 16 to adjust the width of the opening 95. The ejection guide 91 including the opening width adjuster 70 as illustrated in FIG. 16 can prevent the non-standard-size sheet of plain paper from being caught by the end of the entry guide around the opening 95 in the width direction, and the non-standard-size sheet can be satisfactorily conveyed. In addition, since the non-standard-size envelope passes through the opening 95 and is ejected, the envelope crease can be favorably prevented.

In FIG. 21, the entry guide 61 guides the envelope and the large sheet of plain paper in different guide directions. However, the entry guide may not change the guide direction between the envelope and the large sheet of plain paper. The entry guide may guide the envelope to enter the fixing nip similarly to the large sheet of plain paper. That is, the entry guide may guide the envelope toward the fixing roller to press the envelope against the outer peripheral surface of the fixing roller so that the envelope enters the fixing nip. As illustrated in FIG. 20, even when the entry guide angle β is 20°, setting the ejection guide angle γ to be 5° or less can favorably decrease the envelope crease. Accordingly, only the ejection guide may change the guide direction of the large sheet of plain paper from the guide direction of the envelope to favorably reduce the envelope crease, the creases on plain paper printed on both sides, and the back curl of the sheet of plain paper in the single side printing mode.

The configurations described above are examples, and aspects of the present disclosure provide respective effects as follows.

First Aspect

In a first aspect, a fixing device such as the fixing device 44 includes a heater such as the heater 44*c*, a heating rotator such as the fixing roller 44*a*, a nip formation rotator such as the pressure roller 44*b*, an entry guide such as the entry guide 61. The heater is configured to heat the heating rotator. The nip formation rotator is in contact with the heating rotator to form a fixing nip. The entry guide is configured to guide a recording medium to the fixing nip. The entry guide includes a first entry guide portion such as the first entry guide portion 62*a* and a second entry guide portion such as the second entry guide portion 63*a*. The first entry guide portion is configured to guide a recording medium having a predetermined length or more in an axial direction of the heating rotator toward a harder one of the heating rotator and the nip formation rotator. The first entry guide portion has an opening such as the opening 65 disposed corresponding to a center of the heating rotator. The opening is configured to pass a recording medium having a length in the axial direction less than the predetermined length. The second entry guide portion is configured to guide the recording medium having the length less than the predetermined length and passing through the opening of the first entry guide portion to the fixing nip along a reference line connecting the entry N1 of the fixing nip and the exit N2 of the fixing nip in a cross-section of the fixing device orthogonal to the axial direction, or guide the recording medium having the length less than the predetermined length and passing through the opening of the first entry guide portion from a region including a softer one of the heating rotator and the nip formation rotator with respect to the reference line to the fixing nip in the cross-section of the fixing device orthogonal to the axial direction.

According to the first aspect, the recording medium having the length in the axial direction of the heating rotator shorter than the predetermined length, such as the envelope passes through the opening of the first entry guide portion, and the recording medium having the length in the axial direction of the heating rotator equal to or longer than the predetermined length, such as the sheet of plain paper is guided by the first entry guide portion. The above-described configuration enables the entry guide fixed on the fixing device to switch a guide direction between the envelope and the large sheet of plain paper. The above-described configuration is simpler than the configuration in which the entry guide is rotatably attached to the fixing device and switch the orientation of the entry guide between the envelope and the large sheet of plain paper to switch the guide direction and reduces the cost.

The first entry guide portion guiding the recording medium toward the harder one of the heating rotator and the nip formation rotator reduces the creases on plain paper printed on both size as described in the above experiment results. The second entry guide portion guides the envelope so that the envelope enters the fixing nip along the reference line K connecting the entry of the fixing nip and the exit of the fixing nip in the cross-section of the fixing device orthogonal to the axial direction or guides the envelope from the region including a softer one of the heating rotator and the nip formation rotator with respect to the reference line K to the fixing nip in the cross-section of the fixing device orthogonal to the axial direction. The above-described configuration reduces the envelope crease as described in the above experiment results.

Second Aspect

In a second aspect, the fixing device according to the first aspect includes a spur roller such as the spur roller 64 adjacent to a surface of the first entry guide portion such as the first entry guide portion 62*a*. The surface forms the opening such as the opening 65 and faces a printed surface of the recording medium.

According to the second aspect, the spur rollers 64 prevents the printed surface of the recording medium such as the sheet S on which the toner image is formed from rubbing against the facing surface forming the opening such as the opening 65, preventing the toner image formed on the printed surface from disturbing, as described in the embodiments.

Third Aspect

In a third aspect, the fixing device according to the first aspect or the second aspect can convey the recording medium having a width of the letter size as the maximum width of the recording medium and includes the opening having a length in the axial direction that is 148 mm or more and 182 mm or less.

The configuration according to the third aspect prevents the standard-size sheet passing through the opening from being caught by the end of the entry guide around the opening in the axial direction and prevents the occurrence of the jam, as described in the embodiments.

Fourth Aspect

In a fourth aspect, the fixing device according to any one of the first aspect to the third aspect further includes an entry adjuster such as the opening width adjuster 70 to adjust a length of the opening in the axial direction.

According to the fourth aspect, the entry adjuster adjusts the length of the opening in the axial direction to be different from the length of the recording medium passing through the opening in the axial direction if the width of the recording medium passing through the opening is close to the length of the opening in the axial direction, as described in the embodiments. The above-described configuration prevents the sheet passing through the opening from being caught by the end of the entry guide around the opening in the axial direction, which prevents the occurrence of the jam of not only the standard-size sheet but also the non-standard-size sheet.

Fifth Aspect

In a fifth aspect, the entry adjuster such as the opening width adjuster 70 in the fixing device according to the fourth aspect includes a pair of adjuster parts such as the pair of opening width adjuster parts 71 movable in the axial direction.

According to the fifth aspect, moving the pair of adjuster parts adjusts the length of the opening in the axial direction, as described in the embodiment.

Sixth Aspect

In a sixth aspect, the fixing device according to any one of the first aspect to the fifth aspect includes the first entry guide portion such as the first entry guide portion 62*a* having an entry guide angle such as the entry guide angle β that is 15° or more and 25° or less and the second entry guide portion such as the second entry guide portion 63*a* having the entry guide angle that is −20° or more and 0° or less in the cross-section of the fixing device orthogonal to the axial direction of the heating rotator such as the fixing roller 44*a*. In the above, the recording medium guided at a positive entry guide angle is guided to a region including a harder one of the heating rotator and the nip formation rotator such as pressure roller 44*b* with reference to the reference line K in the cross-section, and the recording medium guided at a negative entry guide angle is guided to a region including a softer one of the heating rotator and the nip formation rotator with reference to the reference line K in the cross-section. In the present embodiments, the harder one is the fixing roller 44*a*, and the softer one is pressure roller 44*b*.

The configuration according to the sixth aspect favorably reduces the envelope crease and the creases on the large sheet of plain paper printed on both sides as described in the embodiments.

Seventh Aspect

In a seventh aspect, the fixing device according to any one of the first aspect to the sixth aspect further includes an ejection guide such as the ejection guide 91. The ejection guide guides the recording medium passing through the fixing nip and includes a first ejection guide such as the first ejection guide 92 and a second ejection guide such as the second ejection guide 93. The first ejection guide guides the recording medium having the predetermined length or more and has an opening such as the opening 95 in the embodiments disposed corresponding to the center of the heating rotator. The recording medium having a length in the axial direction less than the predetermined length passes through the opening. The second ejection guide guides the recording medium having the length less than the predetermined length and passing through the opening of the first ejection guide to the fixing nip.

According to the seventh aspect, the fixing device includes different ejection guides, one guides the large sheet of plain paper, and the other guides the envelope, as described in the embodiments. The above-described configuration can guide the large sheet of plain paper so as not to cause back curl and the envelope so as not to cause the crease and prevent the occurrence of the back curl of the large sheet of plain paper and the envelope crease.

Eighth Aspect

In an eighth aspect, a fixing device such as the fixing device 44 includes a heater such as the heater 44*c*, a heating rotator such as the fixing roller 44*a*, a nip formation rotator such as the pressure roller 44*b*, an ejection guide such as the ejection guide 91. The heater is configured to heat the heating rotator. The nip formation rotator is in contact with the heating rotator to form a fixing nip. The ejection guide is configured to guide the recording medium passing through the fixing nip. The ejection guide includes the first ejection guide such as the first ejection guide 92 and a second ejection guide such as the second ejection guide 93. The first ejection guide is configured to guide the recording medium having the predetermined length or more and has an opening such as the opening 95 in the embodiments disposed corresponding to the center of the heating rotator. The recording medium having the length in the axial direction less than the predetermined length passes through the opening. The second ejection guide is configured to guide the recording medium having the length less than the predetermined length and passing through the opening of the first ejection guide to the fixing nip.

According to the eighth aspect, the fixing device includes different ejection guides, one guides the large sheet of plain paper, and the other guides the envelope, as described in the embodiments. The above-described configuration can guide the large sheet of plain paper so as not to cause back curl and the envelope so as not to cause the crease and prevent the occurrence of the back curl of the large sheet of plain paper and the envelope crease.

Ninth Aspect

In a ninth aspect, the fixing device according to the seventh aspect or the eighth aspect includes the first ejection guide and the second ejection guide that are configured as follows. The first ejection guide such as the first ejection guide 92 is configured to guide the recording medium to a region including the harder one of the heating rotator such as the fixing roller 44*a* and the nip formation rotator such as pressure roller 44*b* with reference to a reference line such as the reference line K connecting the entry N1 of the fixing nip and the exit N2 of the fixing nip in the cross-section of the fixing device orthogonal to the axial direction. The second ejection guide such as the second ejection guide 93 is configured to guide the recording medium to a region including a softer one of the heating rotator and the nip formation rotator with reference to the reference line in the cross-section of the fixing device orthogonal to the axial direction or guide the recording medium to a position nearer to the reference line than the first ejection guide in the cross-section of the fixing device orthogonal to the axial direction. In the embodiments, the harder one is the fixing roller 44*a*, and the softer one is pressure roller 44*b*.

The configuration according to the ninth aspect reduces the envelope crease and the back curl of the large sheet of plain paper as described in the embodiments.

Tenth Aspect

In a tenth aspect, the fixing device according to any one of the seventh aspect to the ninth aspect further includes another ejection guide such as the upper ejection guide 81 facing the first ejection guide such as the first ejection guide 92.

According to the tenth aspect, the ejection guide such as the upper ejection guide 81 facing the first ejection guide such as the first ejection guide 92 can prevent the recording medium guided by the first ejection guide such as the first ejection guide 92 from rising toward the harder one of the heating rotator and the nip formation rotator such as the pressure roller 44*b*, thereby conveying the recording medium guided by the first ejection guide such as the first ejection guide 92 in a predetermined direction, as described in the embodiments. In the embodiments, the harder one is the fixing roller 44*a*.

Eleventh Aspect

In an eleventh aspect, the fixing device according to any one of the seventh aspect to the tenth aspect includes the first ejection guide such as the first ejection guide 92 having an ejection guide angle such as the ejection guide angle $\gamma$ that is 18° or more and 24° or less and the second ejection guide such as the second ejection guide 93 having the ejection guide angle that is −10° or more and 5° or less in the cross-section of the fixing device orthogonal to the axial direction of the heating rotator such as the fixing roller 44*a*. In the above, the recording medium guided at a positive ejection guide angle is guided to a region including the harder one of the heating rotator and the nip formation rotator such as the pressure roller 44*b* with reference to the reference line connecting the entry of the fixing nip and the exit of the fixing nip in the cross-section, and the recording medium guided at a negative ejection guide angle is guided to a region including a softer one of the heating rotator and the nip formation rotator with reference to the reference line in the cross-section.

According to the eleventh aspect, the first ejection guide that guides the large sheet of plain paper can favorably prevent the back curl, and the second ejection guide that guides the envelope can favorably prevent the envelope crease as described in the embodiments.

Twelfth Aspect

In a twelfth aspect, the fixing device according to any one of the seventh aspect to the eleventh aspect includes a spur roller such as the spur roller 94 adjacent to a surface of the first ejection guide. The surface of the first ejection guide forms the opening such as the opening 95 and faces a surface of the recording medium. The surface of the recording medium is a surface facing a harder one of the heating rotator such as the fixing roller 44*a* and the nip formation rotator such as the pressure roller 44*b*.

According to the twelfth aspect, the small sheet of plain paper passing through the opening in the ejection guide comes into contact with the spur roller 94 when the small sheet of plain paper floats up toward the harder one of the heating rotator and the nip formation rotator as described in the embodiments. The spur roller such as the spur roller 94 can receive the small sheet of plain paper moving toward the spur roller and convey the small sheet of plain paper in the sheet conveyance direction, which prevents the small sheet of plain paper from largely switching the sheet conveyance direction toward the softer one of the heating rotator and the nip formation rotator (that is the pressure roller 44*b* in the embodiments). As a result, the back curl of the small sheet of plain paper passing through the opening in the ejection guide can be reduced.

Thirteenth Aspect

In a thirteenth aspect, the fixing device according to the seventh aspect or the twelfth aspect can convey the recording medium having a width of the letter size as the maximum width of the recording medium and includes the opening such as the opening 95 having a length in the axial direction that is 148 mm or more and 182 mm or less.

The configuration according to the thirteenth aspect prevents an end of the standard-size sheet in the width direction of the recording medium from being caught by the end of the entry guide around the opening in the axial direction and prevents the occurrence of the jam, as described in the embodiments.

Fourteenth Aspect

In a fourteenth aspect, the fixing device according to any one of the seventh aspect to the thirteenth aspect further includes an ejection adjuster to adjust a length of the opening in the first ejection guide in the axial direction (that is the length of the opening 95 in the present embodiments).

According to the fourteenth aspect, the ejection adjuster adjusts the length of the opening in the axial direction to be different from the length of the recording medium passing through the opening in the axial direction if the length, in the axial direction, of the recording medium passing through the opening is close to the length of the opening in the axial direction, as described in the embodiments. The above-described configuration prevents the sheet passing through the opening from being caught by the end of the ejection guide around the opening in the axial direction, which prevents the occurrence of the jam of not only the standard-size sheet but also the non-standard-size sheet.

Fifteenth Aspect

In a fifteenth aspect, the ejection adjuster in the fixing device according to the fourteenth aspect includes a pair of adjuster parts movable in the axial direction.

According to the fifteenth aspect, moving the pair of adjuster parts adjusts the length of the opening in the axial direction, as described in the embodiment.

Sixteenth Aspect

In a sixteenth aspect, an image forming apparatus includes the fixing device such as the fixing device 44 according to any one of the first aspect to the fifteenth aspect.

According to the sixteenth aspect, the image forming apparatus can include an inexpensive fixing device that reduce the envelope crease, the creases on the large sheet of plain paper printed on both sides, the back curl of the large sheet of plain paper.

Seventeenth Aspect

In a seventeenth aspect, the image forming apparatus according to the sixteenth aspect further includes an image bearer such as photoconductor 1 and a transferor such as the transfer roller 10 in contact with the image bearer to form a transfer nip. The transferor is disposed upstream in a recording medium conveyance direction from the fixing device. The fixing device includes the entry guide such as the entry guide 61. The entry guide is configured to guide the recording medium to the fixing nip. The entry guide includes the first entry guide portion such as the first entry guide portion 62*a* and the second entry guide portion such as the second entry guide portion 63*a*. The first entry guide portion is configured to guide the recording medium having a predetermined length or more in the axial direction of the heating rotator such as the fixing roller 44*a* toward the harder one of the heating rotator and the nip formation rotator. The first entry guide portion has an opening such as the opening 65 disposed corresponding to the center of the heating rotator. The opening is configured to pass a recording medium having a length in the axial direction less than the predetermined length. The second entry guide portion is configured to guide the recording medium having the length less than the predetermined length and passing through the opening of the first entry guide portion to the fixing nip along a reference line connecting the entry N1 of the fixing nip and the exit N2 of the fixing nip in a cross-section of the fixing device orthogonal to the axial direction, or guide the recording medium having the length less than the predetermined length and passing through the opening of the first entry guide portion from a region including a softer one of the heating rotator and the nip formation rotator with respect to the reference line to the fixing nip in the cross-section of the fixing device orthogonal to the axial direction. In addition, a line connecting a center of the fixing nip and a point closest to the second entry guide portion on a surface of the first entry guide portion around the opening and facing a printed surface of the recording medium is parallel to or overlap a line connecting the center of the fixing nip and a center of the transfer nip.

According to the seventeenth aspect, the recording medium that has passed through the transfer nip can enter the fixing nip with little change in the conveyance direction of the recording medium as described in the embodiments. Thus, the image forming apparatus can be downsized.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A fixing device comprising:

a heater;

a heating rotator configured to be heated by the heater;

a nip formation rotator in contact with the heating rotator to form a fixing nip; and an entry guide configured to guide each of a first recording medium having a predetermined length or more in an axial direction of the heating rotator and a second recording medium having a length less than the predetermined length in the axial direction to the fixing nip, the entry guide including:

a first entry guide portion configured to guide the first recording medium toward a harder one of the heating rotator and the nip formation rotator, the first entry guide portion having an opening disposed corresponding to a center of the heating rotator, and the first entry guide portion configured to pass the second recording medium through the opening; and a second entry guide portion configured to guide the second recording medium passing through the opening of the first entry guide portion to the fixing nip along a reference line connecting an entry of the fixing nip and an exit of the fixing nip in a cross-section of the fixing device orthogonal to the axial direction, or guide the second recording medium passing through the opening of the first entry guide portion from an area including a softer one of the heating rotator and the nip formation rotator with respect to the reference line to the fixing nip in the cross-section of the fixing device orthogonal to the axial direction.

2. The fixing device according to claim 1, further comprising a spur roller adjacent to a surface of the first entry guide portion, the surface forming the opening and being configured to face a printed surface of the second recording medium.

3. The fixing device according to claim 1, wherein a length of the opening in the axial direction is 148 mm or more and 182 mm or less.

4. The fixing device according to claim 1, further comprising an entry adjuster configured to adjust a length of the opening in the axial direction.

5. The fixing device according to claim 4, wherein the entry adjuster includes a pair of adjuster parts configured to be movable in the axial direction.

6. The fixing device according to claim 1, wherein an entry guide angle of the first entry guide portion is 15° or more and 25° or less, and an entry guide angle of the second entry guide portion is −20° or more and 0° or less in the cross-section of the fixing device orthogonal to the axial direction of the heating rotator, and wherein a recording medium guided at a positive entry guide angle is guided to an area including a harder one of the heating rotator and the nip formation rotator with reference to the reference line in the cross-section, and a recording medium guided at a negative entry guide angle is guided to the area including the softer one of the heating rotator and the nip formation rotator with reference to the reference line in the cross-section.

7. The fixing device according to claim 1, further comprising an ejection guide configured to guide each of the first recording medium and the second recording medium that pass through the fixing nip, the ejection guide including:

a first ejection guide configured to guide the first recording medium, the first ejection guide having an opening disposed corresponding to the center of the heating rotator, and the first ejection guide configured to pass the second recording medium through the opening; and a second ejection guide configured to guide the second recording medium passing through the opening of the first ejection guide.

8. An image forming apparatus comprising the fixing device according to claim 1.

9. The image forming apparatus according to claim 8, further comprising:

an image bearer; and a transferor in contact with the image bearer to form a transfer nip, the transferor disposed upstream from the fixing device in a recording medium conveyance direction, wherein a line connecting a center of the fixing nip and a point closest to the second entry guide portion on a surface of the first entry guide portion around the opening and facing a printed surface of the second recording medium is parallel to or overlap a line connecting the center of the fixing nip and a center of the transfer nip in the cross-section.

10. A fixing device comprising:

a heater;

a heating rotator configured to be heated by the heater;

a nip formation rotator in contact with the heating rotator to form a fixing nip; and an ejection guide configured to guide each of a first recording medium having a predetermined length or more in an axial direction of the heating rotator and passing through the fixing nip and a second recording medium having a length less than the predetermined length in the axial direction and passing through the fixing nip, the ejection guide including:

a first ejection guide configured to guide the first recording medium, the first ejection guide having an opening disposed corresponding to the center of the heating rotator, and the first ejection guide configured to pass the second recording medium through the opening; and a second ejection guide configured to guide the second recording medium passing through the opening of the first ejection guide.

11. The fixing device according to claim 10, wherein the first ejection guide is configured to guide the first recording medium to an area including a harder one of the heating rotator and the nip formation rotator with reference to a reference line connecting an entry of the fixing nip and an exit of the fixing nip in a cross-section of the fixing device orthogonal to the axial direction, and wherein the second ejection guide configured to guide the second recording medium to an area including a softer one of the heating rotator and the nip formation rotator with reference to the reference line in the cross-section of the fixing device orthogonal to the axial direction or guide the second recording medium to a position nearer to the reference line than the first ejection guide in the cross-section of the fixing device orthogonal to the axial direction.

12. The fixing device according to claim 10, further comprising another ejection guide facing the first ejection guide.

13. The fixing device according to claim 10, wherein an ejection guide angle of the first ejection guide is 18° or more and 24° or less, and an ejection guide angle of the second ejection guide is −10° or more and 5° or less in a cross-section of the fixing device orthogonal to the axial direction of the heating rotator, and wherein a recording medium guided at a positive ejection guide angle is guided to an area including a harder one of the heating rotator and the nip formation rotator with reference to a reference line connecting an entry of the fixing nip and an exit of the fixing nip in a cross-section of the fixing device orthogonal to the axial direction, and a recording medium guided at a negative ejection guide angle is guided to an area including a softer one of the heating rotator and the nip formation rotator with reference to the reference line in the cross-section.

14. The fixing device according to claim 10, further comprising a spur roller adjacent to a surface of the first ejection guide, the surface forming the opening and being configured to face a surface of the second recording medium, wherein the surface of the second recording medium is a surface facing a harder one of the heating rotator and the nip formation rotator.

15. The fixing device according to claim 10, wherein a length of the opening in the axial direction is 148 mm or more and 182 mm or less.

16. The fixing device according to claim 10, further comprising an ejection adjuster configured to adjust a length of the opening in the axial direction.

17. The fixing device according to claim 16, wherein the ejection adjuster includes a pair of adjuster parts configured to be movable in the axial direction.

18. An image forming apparatus comprising the fixing device according to claim 10.

19. The image forming apparatus according to claim 18, further comprising:

an image bearer;

a transferor in contact with the image bearer to form a transfer nip, the transferor disposed upstream in a recording medium conveyance direction from the fixing device;

an entry guide configured to guide each of the first recording medium and the second recording medium to the fixing nip, the entry guide including:

a first entry guide portion configured to guide the first recording medium toward a harder one of the heating rotator and the nip formation rotator, the first entry guide portion having an opening disposed corresponding to a center of the heating rotator, the opening configured to pass the second recording medium; and a second entry guide portion configured to guide the second recording medium passing through the opening of the first entry guide portion to the fixing nip along a reference line connecting an entry of the fixing nip and an exit of the fixing nip in the cross-section of the fixing device orthogonal to the axial direction, or guide the second recording medium passing through the opening of the first entry guide portion from an area including a softer one of the heating rotator and the nip formation rotator with respect to the reference line to the fixing nip in the cross-section of the fixing device orthogonal to the axial direction, wherein a line connecting a center of the fixing nip and a point closest to the second entry guide portion on a surface of the first entry guide portion around the opening and facing a printed surface of the second recording medium is parallel to or overlap a line connecting the center of the fixing nip and a center of the transfer nip.

* * * * *